US006762376B2

(12) United States Patent
Nakamura et al.

(10) Patent No.: US 6,762,376 B2
(45) Date of Patent: Jul. 13, 2004

(54) CIRCUIT BREAKING APPARATUS

(75) Inventors: Goro Nakamura, Shizuoka (JP); Takahiro Satoh, Shizuoka (JP); Hidenori Yokoyama, Aichi (JP); Hiroshi Kobayashi, Aichi (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/125,552

(22) Filed: Apr. 19, 2002

(65) Prior Publication Data

US 2002/0153232 A1 Oct. 24, 2002

(30) Foreign Application Priority Data

| | | |
|---|---|---|
| Apr. 20, 2001 | (JP) | 2001-122797 |
| Apr. 20, 2001 | (JP) | 2001-122816 |
| Apr. 20, 2001 | (JP) | 2001-122820 |
| Apr. 20, 2001 | (JP) | 2001-122833 |
| Apr. 20, 2001 | (JP) | 2001-123373 |

(51) Int. Cl.[7] ..... F21V 23/04

(52) U.S. Cl. ..... 200/60; 200/51.09; 200/51.01; 439/181

(58) Field of Search ..... 200/17 R, 11 A, 200/181, 237, 254; 218/14

(56) References Cited

U.S. PATENT DOCUMENTS 3,691,511 A 9/1972 Billmann 4,224,486 A 9/1980 Zimmerman, Jr. et al.

FOREIGN PATENT DOCUMENTS

| | | |
|---|---|---|
| DE | 515764 | 1/1931 |
| DE | 736367 | 6/1943 |
| DE | 44 39 671 A1 | 5/1996 |
| EP | 0 742 568 A2 | 11/1996 |
| FR | 1.574.185 | 7/1969 |
| JP | 3067588 | 5/2000 |
| WO | WO 01/28062 A1 | 4/2001 |

*Primary Examiner*—Elvin Enad
*Assistant Examiner*—Jennifer A. Poker
(74) *Attorney, Agent, or Firm*—Sughrue Mion, PLLC

(57) ABSTRACT

A load side terminal connected to a load portion, a power source side terminal connected to a power source portion and a sacrifice electric pole connected to the power source side terminal are fixed to an apparatus main body. A movable plug is provided movably to the apparatus main body. The sacrifice electrode is constituted by a sacrifice electric pole with resistor connected to the power source side terminal via a resistor and a through sacrifice electric pole directly connected to the power source side terminal and arranged to shift from each other such that in a procedure of moving a conductive portion of the movable plug from a circuit opened position to a circuit closed position. The conductive portion is firstly brought into contact with the load side terminal, successively brought into contact with the sacrifice electric pole and finally brought into contact with the power source side terminal.

26 Claims, 22 Drawing Sheets

CIRCUIT BREAKING APPARATUS

BACKGROUND OF THE INVENTION

The present invention relates to a circuit breaking apparatus for electrically breaking an interval between a power source portion and a load portion.

In the case of, for example, an electric automobile, a capacity of a power source which is a battery, is larger than that of an ordinary gasoline engine vehicle or the like. Therefore, when an electric system or the like thereof is subjected to maintenance, a power source circuit is opened (turned off) by a circuit breaking apparatus to thereby ensure safety of operation. There is a related circuit breaking apparatus of this kind as shown by FIG. 26.

As shown by FIG. 26, a circuit breaking apparatus 200 is provided with a main relay 202 and a sub relay 203 respectively controlled to open and close by a control unit 201 and both of the main relay 202 and the sub relay 203 are provided with power source side terminals 205 and 206 connected to a power source portion 204 and load side terminals 208 and 209 connected to a load portion 207. The load side terminal 209 of the sub relay 203 is connected to the load portion 207 by way of a resistor 210.

According to the above-described constitution, when the main relay 202 and the sub relay 203 are disposed at opened positions and a power source circuit is closed, there is carried out a control of closing firstly the sub relay 203 and closing the main relay 202 after elapse of a predetermined time period by the control unit 201. The power source portion 204 and the load portion 207 are connected via the resistor 210 by firstly closing the sub relay 203 and therefore, a capacitor or the like of the load portion 207 is charged by small current and after charging has been finished, the main relay 202 is closed to thereby connect the power source portion 204 and the load portion 207 directly without interposing a resistor.

That is, in the case in which the load portion 207 is provided with a capacitor or the like, when the sub relay 203 is not provided and only the main relay 202 is provided and the power source portion 204 and the load portion 207 are abruptly connected directly without interposing a resistor, in bringing the power source side terminal 205 and the load side terminal 208 into contact with each other, large current flows to the capacitor or the like via the terminals and therefore, arc discharge is generated between the terminals 205 and 208 and there is brought about a situation of melting the terminals 205 and 208. Hence, the sub relay 203 is provided other than the main relay 202 to thereby prevent the terminals from being melted by arc discharge.

However, according to the related circuit breaking apparatus 200, there are needed two relays of the main relay 202 and the sub relay 203 and there is needed the control unit 201 for controlling the relays and therefore, there poses a problem that the cost is high and the apparatus is complicated and large-sized.

There is provided an another circuit breaking apparatus of this kind disclosed in Japanese Patent Laid-Open No. 306265/1996 shown in FIG. 27.

As shown by FIG. 27, there is provided a switch mechanism containing chamber 302 at inside of an apparatus main body 301 of the circuit breaking apparatus 300 and the switch mechanism containing chamber 302 is provided with a pair of rod terminals 303 and 304. The pair of rod terminals 303 and 304 are arranged on a straight line at positions separated from each other. Further, the switch mechanism containing chamber 302 is arranged with a connection cylinder portion 305 of a conductive member in a cylindrical shape and elastic contact portions 306 are provided at two locations on an inner peripheral side of the connection cylinder portion 305.

Further, an operating lever member 307 is supported by the connection cylinder portion 305 via a support pin 307*a* and a lower end of the operating lever member 307 is provided at the apparatus main body 301 rotatably via a rotating shaft 308. An upper end of the operating lever member 307 is exposed to outside from the apparatus main body 301 and a grub portion 309 is provided at the upper end of the exposed operating lever member 307. By operating the operating lever member 307, the connection cylinder portion 305 is moved to slide between a conducting position shown by bold lines in FIG. 27 and a breaking position shown by imaginary lines in FIG. 27.

According to the above-described constitution, the pair of rod terminals 303 and 304 can electrically be connected by disposing the connection cylinder portion 305 at the conducting position by operating the operating lever member 307 and the pair of rod terminals 303 and 304 can electrically be broken by disposing the connection cylinder portion 305 at the breaking position by operating the operating lever member 307. That is, in order to move to slide the connection cylinder portion 305, the operating lever member 307 is connected to the connection cylinder portion 305, a fulcrum of force is constituted by one end side (lower end side) of the operating lever member 307, a force exerting point of the force is constituted by other end side (upper end) of the operating lever member 307 and the connection cylinder portion 305 can be moved by small operating force by utilizing the principle.

However, it is necessary to provide the operating lever member 307 rotatably supported by the connection cylinder portion 305 and move the upper end side of the operating lever 307 (grub portion 309) in parallel with sliding movement of the connection cylinder portion 305 and therefore, there poses a problem that the apparatus is large-sized.

In this case, in order to resolve large-sized formation of the apparatus, there is conceivable a constitution in which a movable plug is provided to be simply able to insert and extract to and from an apparatus main body, a pair of terminals are connected via a conductive portion of the movable plug by inserting the movable plug into the apparatus main body and the pair of terminals are broken by drawing the movable plug from the apparatus main body. However, according to such an apparatus, it is necessary to prevent erroneous insertion by which the movable plug is inserted to the apparatus main body not at a regular rotational position. That is, because according to a constitution in which the movable plug is locked at a circuit closed position, there is a concern of causing inconvenience that the movable plug cannot be locked unless the movable plug is inserted at the regular rotational position, or according to a constitution in which the movable plug is brought into proper contact with the terminal at an inner portion only at a proper rotational position, there is a concern of bringing about various inconveniences of causing contact failure, terminal destruction and the like. Further, according to such an apparatus, when the movable plug is simply inserted into the apparatus main body, large operational force is needed and therefore, a guide groove is provided on the side of the apparatus main body and a projection capable of being inserted into the guide groove is provided at the movable plug, respectively, further, there is provided a guide portion for rotation inclined in a skewed depth direction relative to a direction orthogonal to an inserting direction at a section of the guide groove from a position before finishing to insert the movable plug to a position of finishing to insert the movable plug. Further, it is conceivable that after inserting the movable plug into the apparatus main body to some degree, the movable plug is inserted while rotating the movable plug by operating to rotate the movable plug (convert rotational force into inserting force), thereby, the movable plug is inserted thereinto by small operational force.

However, according to the constitution having the operation of inserting the movable plug and the operation of rotating the movable plug, there is a possibility that an operator misunderstands that the operation has been finished at a time point of finishing the operation of inserting the movable plug and stops operating the operation of the movable plug. Further, when the final operation of rotating the movable plug is not carried out in this way, there poses a problem that there is brought about an incompletely fitted state in which the conductive portion and the terminal cannot firmly be fitted to each other.

There is another related circuit breaking apparatus of this kind disclosed in Japanese Patent Laid-Open No. 144429/1998 shown in FIG. 28 and FIG. 29.

As shown by FIG. 28 and FIG. 29, the circuit breaking apparatus 400 is constituted by an apparatus main body 401 and a movable plug 402 provided attachably and detachably to the apparatus main body 401. The apparatus main body 401 is provided with a pair of female terminals 403 and one of the pair of female terminals 403 is electrically connected to a load portion and other thereof is electrically connected to a power source portion, respectively. A plug insertion hole 404 is formed at a surrounding of the pair of female terminals 403 of the apparatus main body 401 and a pair of guide grooves 405 are formed on left and right sides of an outer periphery of the plug insertion hole 404.

The movable plug 402 is provided with an operating lever 407 provided with a pair of projections 406 at left and right side faces thereof, a plug main body 409 rotatably provided to the operating lever 407 via a rotation support shaft 408 and a pair of male terminals 411 fixed to the plug main body 109 and electrically connected thereto by a bus bar 410.

An operator grubs the operating lever 407, matches the pair of projections 406 to the pair of guide grooves 405 of the apparatus main body 401 and inserts the plug main body 409 into the plug insertion hole 404 of the apparatus main body 401. Then, by a stroke of inserting the movable plug 402, the male terminals 411 are inserted into the female terminals 403 and an interval between the pair of female terminals 403 are electrically connected by the pair of male terminals 411 and the bus bar 410 to thereby bring a power source circuit into a conductive state. Further, the movable plug 402 mounted to the apparatus main body 401 is drawn from the plug insertion hole 404 of the apparatus main body 401. Then, by a stroke of drawing the movable plug 402, the pair of male terminals 411 are detached from the pair of female terminals 403 and the interval between the pair of female terminals 403 is broken to thereby bring the power source circuit into a broken state.

Meanwhile, in the case in which there is a capacitor or the like at the load portion and when the power source circuit is broken by the circuit breaking apparatus 400, a charged state is maintained at the capacitor or the like of the load portion. Therefore, when maintenance or the like is carried out, it is necessary to discharge the capacitor or the like of the load portion, however, the above-described circuit breaking apparatus 400 is not provided with discharging means. Therefore, it is necessary to separately provide discharging means for connecting the load portion to the ground in a circuit broken state and releasing the load portion from the ground in a circuit conducted state at the power source circuit.

SUMMARY OF THE INVENTION

Hence, the invention has been carried out in order to resolve the above-described problem and it is an object thereof to provide a circuit breaking apparatus which is small-sized, inexpensive and capable of preventing terminals from being melted by arc discharge without using two relay switches and a control circuit thereof.

Another object of the present invention is to provide a circuit breaking apparatus constituting compact formation of the apparatus and capable of preventing erroneous insertion of a movable plug.

Another object of the present invention is to provide a circuit breaking apparatus capable of discharging a capacitor or the like of a load portion when the circuit breaking apparatus is brought into a circuit broken state from a circuit conducted state.

Another object of the present invention is to provide a circuit breaking apparatus capable of preventing leakage current or the like from being caused by arc discharge of a sacrifice electric pole.

Another object of the present invention is to provide a circuit breaking apparatus capable of making the apparatus compact, achieving a reduction in operational force of a movable plug, further, preventing an incompletely fitted state by incompletely inserting the movable plug from being brought about.

In order to solve the aforesaid object, the invention is characterized by having the following arrangement.

(1) A circuit breaking apparatus comprising:

a apparatus body;

a load side terminal connected to a load portion and provided in the apparatus body;

a power source side terminal connected to a power source portion and provided in the apparatus body;

a sacrifice electrode portion connected to the power source side terminal and provided in the apparatus body; and a movable plug including a conductive portion and movable with respect to the apparatus body between a circuit opened position in which the movable plug does not electrically connect the load side terminal to the power source side terminal and a circuit closed position in which the movable plug electrically connects the load side terminal to the power source side terminal, wherein the load side terminal, the power source side terminal and the sacrifice electrode portion are shifted in a direction of moving the movable plug such that when the movable plug is moved from the circuit opened position to the circuit closed position, the conductive portion is brought into contact with the load side terminal, the sacrifice electrode portion and the power source side terminal in order.

(2) The circuit breaking apparatus according to (1), wherein the sacrifice electrode portion includes a first sacrifice electric pole electrically connected to the power source side terminal through a resister, and a second sacrifice electric pole electrically directly connected to the power source side terminal, and when the movable plug is moved from the circuit opened position to the circuit closed position, the movable plug is firstly brought into contact with the first sacrifice electric pole and secondly brought into contact with the second sacrifice electric pole.

(3) The circuit breaking apparatus according to (1), wherein the sacrifice electrode portion is electrically directly connected to the power source side terminal.

(4) The circuit breaking apparatus according to (1), wherein a first face of the conductive portion firstly brought into contact with the sacrifice electrode portion and a second face of the conductive portion brought into contact with the power source side terminal, differ from each other.

(5) The circuit breaking apparatus according to (4), wherein the conductive portion includes a side face which extends along the direction of moving the movable plug and corresponds to the first face and a tapered face on a front end thereof corresponding to the second face.

(6) The circuit breaking apparatus according to (1), wherein the sacrifice electrode portion includes a sacrifice electric pole contactable with the conductive portion and an elastic arm portions connecting the sacrifice electric pole with the power source side terminal.

(7) The circuit breaking apparatus according to (5), wherein the sacrifice electrode portion includes a sacrifice electric pole contactable with the conductive portion and an elastic arm portions connecting the sacrifice electric pole with the power source side terminal, and the sacrifice electric pole is elastically slidable on the side face of the conductive portion.

(8) A circuit breaking apparatus comprising:

an apparatus body;

first and second terminals provided in the apparatus body, respectively;

a movable plug including a conductive portion and movable with respect to the apparatus body between a circuit opened position in which the movable plug does not electrically connect the first terminal to the second terminal and a circuit closed position in which the movable plug electrically connects the first terminal to the second terminal, a guide groove provided at one of the apparatus body and the movable plug; and a projection insertable into the guide groove and provided at the other of the apparatus body and the movable plug, wherein the movable plug is inserted into the apparatus body only when the projection is inserted into the guide groove.

(9) The circuit breaking apparatus according to (8), wherein the first and second terminals have a tubular cylindrical shape, and the conductive portion is a cylindrical rod insertable into the first and second terminals, respectively, so that the conductive portion is electrically connected with the first and second terminals.

(10) The circuit breaking apparatus according to (9), wherein the guide groove has a rotation guide portion extending to a depth side in a direction skewed to a direction orthogonal to a direction of inserting the movable plug, and when the conductive portion is in contact with the first and second terminals, the projection is slid along the rotation guide portion.

(11) The circuit breaking apparatus according to (10), wherein the movable plug includes an operation lever to which the projection or the guide grooves is provided and which rotatably supports the conductive portion.

(12) The circuit breaking apparatus according to (8), wherein the guide groove includes a projection pickup portion having a large width on a side of an insertion port of the apparatus body firstly inserted with the projection and the width is gradually narrowed toward the insertion depth.

(13) The circuit breaking apparatus according to (8), wherein the guide groove including:

a projection pickup portion including a first end portion having a width three to six times as large as a width of the projection on a side of an insertion port of the apparatus body, and a second end portion having a width slightly wider than the width of the projection, the width of the projection pickup portion being gradually narrowed from the first end portion toward the second end portion;

a straight advancement guide portion having a constant width slightly larger than the width of the projection and extending in an insertion direction of inserting the movable plug, one end thereof being communicated with the second end portion; and a rotation guide portion extending to a depth side in a direction skewed to a direction orthogonal to the insertion direction, and communicated with the other end of the straight advancement guide.

(14) The circuit breaking apparatus according to (8), wherein the guide groove includes a rotation guide portion extending in a skewed depth direction relative to a direction orthogonal to a direction of inserting the movable plug, and a rotation introducing guide portion having a large radius of curvature in compared with that of the rotation guide portion, and when the movable plug is moved from the circuit opened position toward the circuit closed position, the projection is moved from a side of the rotation guide portion toward the rotation introducing guide portion.

(15) The circuit breaking apparatus according to (14), wherein when the conductive portion is in contact with the first and second terminals, the projection is slid along the rotation guide portion.

(16) The circuit breaking apparatus according to (8), wherein the guide groove includes a rotation guide portion extending in a skewed depth direction relative to a direction orthogonal to a direction of inserting the movable plug, and a rotation introducing guide portion having a large taper angle relative to the direction orthogonal to the direction of inserting the movable plug, and when the movable plug is moved from the circuit opened position toward the circuit closed position, the projection is moved from a side of the rotation guide portion toward the rotation introducing guide portion.

(17) The circuit breaking apparatus according to (16), wherein when the conductive portion is in contact with the first and second terminals, the projection is slid along the rotation guide portion.

(18) The circuit breaking apparatus according to (8), wherein the guide groove has a curved shape whose a radius of curvature varies.

(19) A circuit breaking apparatus comprising:

an apparatus body;

a load side terminal connected to a load portion and provided in the apparatus body;

a ground side terminal which is connected to the ground, provided in the apparatus body, and movable between a contact position in which the ground side terminal is in contact with the load side terminal and a separated position in which the ground side terminal is separated from the load side terminal;

a power source side terminal connected to a power source portion and provided in the apparatus body;

a movable plug including a conductive portion and movable with respect to the apparatus body between a circuit opened position in which the conductive portion is not in contact with the power source side terminal and a circuit closed position in which the conductive portion is in contact with the load side terminal and the power source side terminal; and an urging member for urging the ground side terminal to the contact position, wherein the ground side terminal is in the contact position when the movable plug is in the circuit opened position, and wherein the ground side terminal is moved to the separated position against urge force of the urging member in when the movable plug is moved from the circuit opened position to the circuit closed position.

(20) The circuit breaking apparatus according to (19), wherein the ground side terminal includes a pair of contact portion holders opposed each other with respect to a movement center axis of the movable plug, in the contact position, the pair of contact portion holders are arranged on a movement locus of the movable plug, and in the separated position, the pair of contact portion holders are moved in directions separating from each other by a press force of the movable plug and arranged at a position for slidably contact with the conductive portion of the movable plug.

(21) The circuit breaking apparatus according to (19), wherein the apparatus body is provided with a sacrifice electrode electrically connected to the power source side terminal, and when the movable plug is moved from the circuit opened position to the circuit closed position, the conductive portion is brought into contact with the load side terminal, the sacrifice electrode and the power source side terminal in order.

(22) The circuit breaking apparatus according to (19), wherein the urging member is a spring.

(23) A circuit breaking apparatus comprising:

an apparatus body;

a load side terminal connected to a load portion and provided in the apparatus body;

a power source side terminal connected to a power source portion and provided in the apparatus body;

a sacrifice electrode which is connected to the power source side terminal, provided in the apparatus body and interposed between the load side terminal and the power source side terminal;

a movable plug including a conductive portion and movable with respect to the apparatus body between a circuit opened position in which the movable plug does not electrically connect the load side terminal with the power source side terminal and a circuit closed position in which the movable plug electrically connects the load side terminal with the power source side terminal; and insulative caps provided at the load side terminal and the power source side terminal, respectively, wherein when the movable plug is moved from the circuit opened position to the circuit closed position, the conductive portion is brought into contact with the load side terminal, the sacrifice electrode and the power source side terminal in order.

(24) The circuit breaking apparatus according to (23), wherein the insulative cap is provided at one end of the load side terminal facing to the sacrifice electrode.

(25) The circuit breaking apparatus according to (23), wherein the insulative cap is provided at one end of the power source side terminal facing to the sacrifice electrode.

(26) The circuit breaking apparatus according to (23), wherein each of the load side terminal and the power source side terminal includes a cylinder ring portion and a multiple point contact spring member arranged at an inner peripheral face of the cylinder ring portion, and the multiple point contact spring member is fixed to the cylinder ring portion by the insulative cap.

BRIEF DESCRIPTION OF THE DRAWINGS

FIGS. 1A through 1C show a first embodiment of the invention in which FIG. 1A is a front view of a circuit breaking apparatus, FIG. 1B is a right side view of the circuit breaking apparatus and FIG. 1C is a bottom view of the circuit breaking apparatus.

FIGS. 8A and 8B show the first embodiment of the invention in which FIG. 8A is a view showing a state in which a conductive portion of the movable plug is brought into contact with the sacrifice electric pole with resistor and FIG. 8B is a view showing a state in which the conductive portion of the movable plug is brought into contact with a through sacrifice electric pole.

FIGS. 9A through 9C show a second embodiment of the invention in which FIG. 9A is a front view of a circuit breaking apparatus, FIG. 9B is a right side view of the circuit breaking apparatus and FIG. 9C is a bottom view of the circuit breaking apparatus.

FIGS. 18A through 18C show the embodiment of the invention in which FIG. 18A is a sectional view of an essential portion of the circuit breaking apparatus showing a state in which the movable plug is inserted (erroneously inserted) at other than a regular rotational position, FIG. 18B is a sectional view of the essential portion of the circuit breaking apparatus showing a state in which the movable plug is inserted at the rotational position and FIG. 18C is a sectional view of the essential portion of the circuit breaking apparatus showing a state in which a projection of the movable plug is inserted up to a deepest position of a guide groove for straight advancement of a guide groove.

FIGS. 23A and 23B show the third embodiment of the invention in which FIG. 23A is an inner face view of the base member showing a state in which a projection of the movable plug is made to advance into a rotation introducing guide portion of a guide groove and FIG. 23B is a side view of the circuit breaking apparatus in the state.

FIGS. 24A and 24B shows the third embodiment of the invention in which FIG. 24A is an inner face view of the base member showing a state in which the projection of the movable plug is made to advance into a guide portion for rotation of the guide groove and FIG. 24B is a side view of the circuit breaking apparatus in the state.

DETAILED DESCRIPTION OF PREFERRED EMBODIMENTS

An explanation will be given of embodiments of the invention in reference to the drawings as follows.

First Embodiment

Figure 1A:
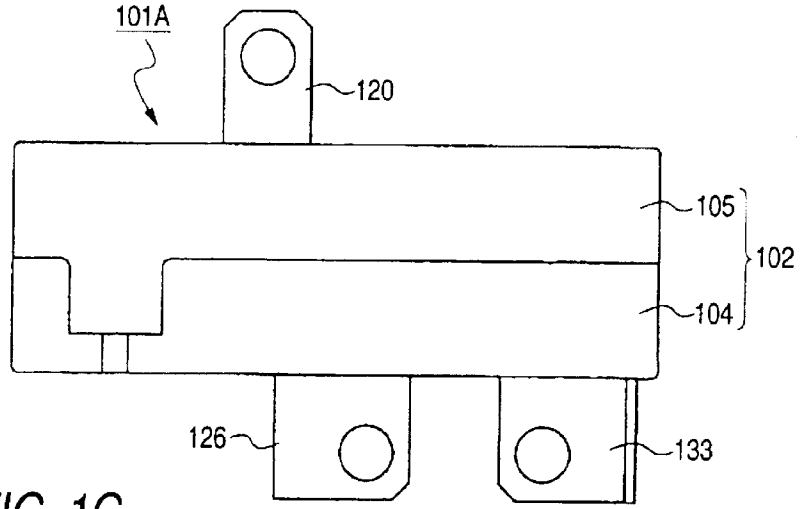
Figure 1B:
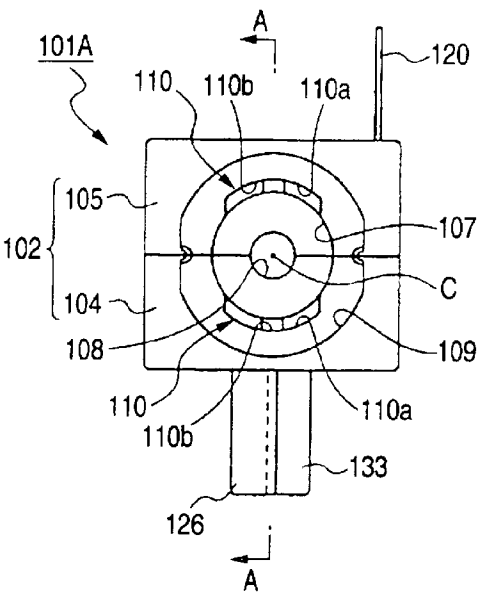
Figure 1C:
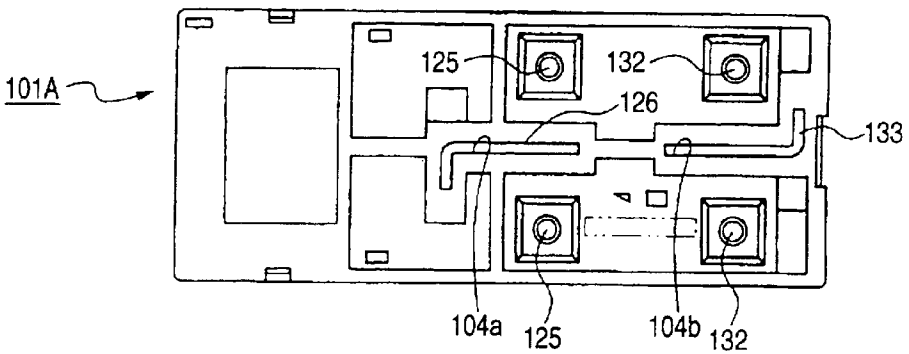
Figure 2:
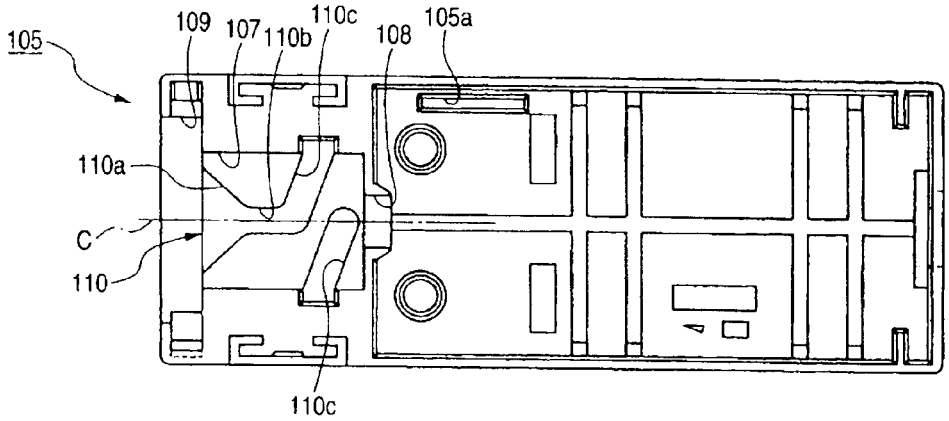
FIG. 2 shows the first embodiment of the invention and is an inner face view of a cover.
Figure 3:
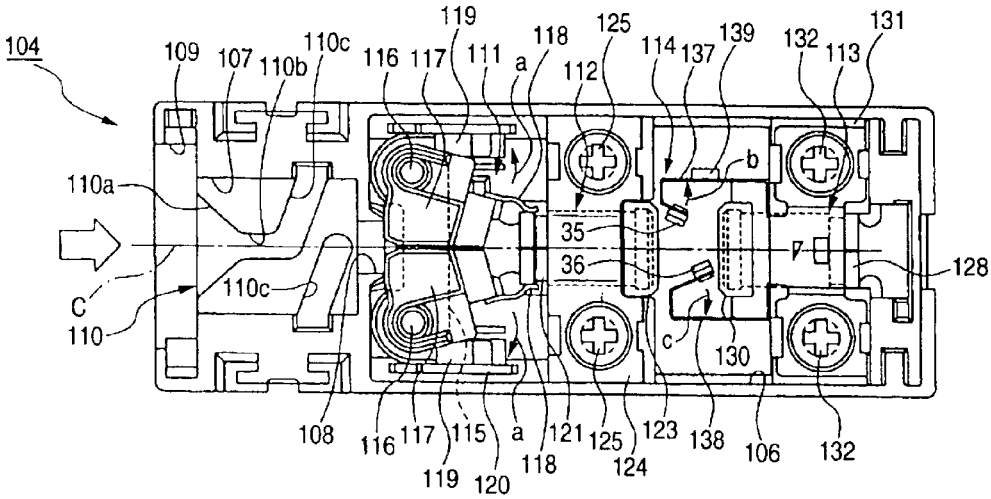
FIG. 3 shows the first embodiment of the invention and is an inner face view of a base member fixed with respective terminals and electric pole parts.
Figure 4:
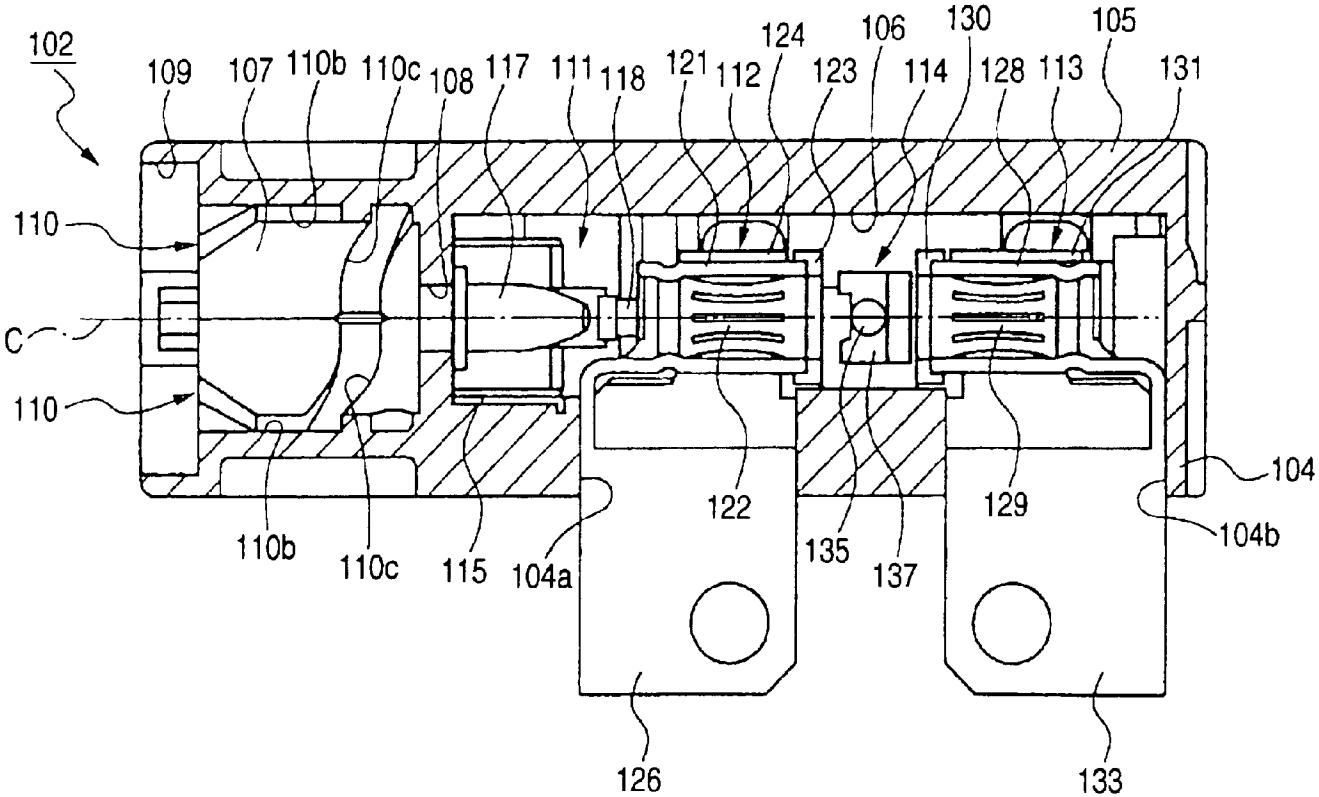
FIG. 4 shows the first embodiment of the invention and is a sectional view taken along a line A—A of FIG. 1B.
Figure 5:
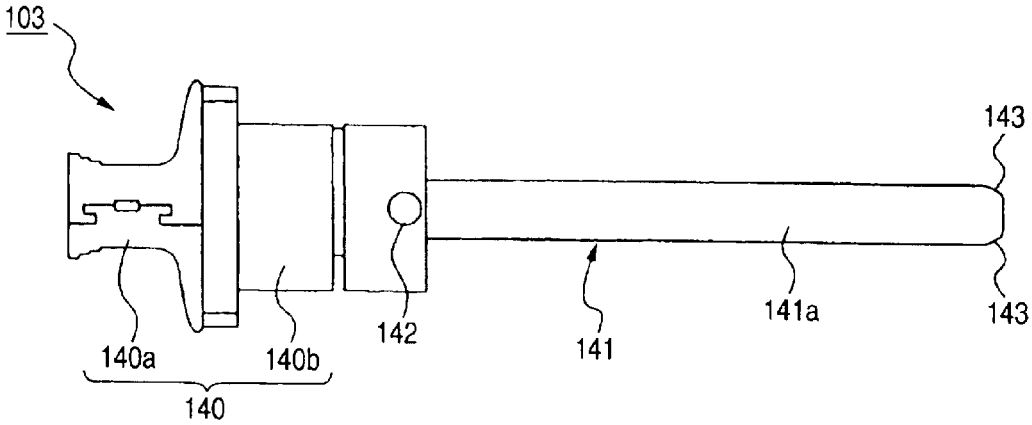
FIG. 5 shows the first embodiment and is a front view of a movable plug.
Figure 6:
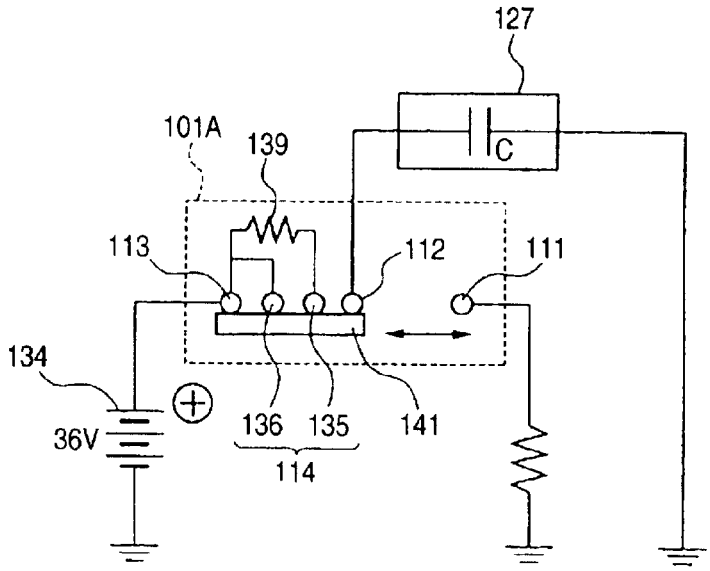
FIG. 6 shows the first embodiment of the invention and is a circuit diagram of a power source circuit mounted with the circuit breaking apparatus.
Figure 7:
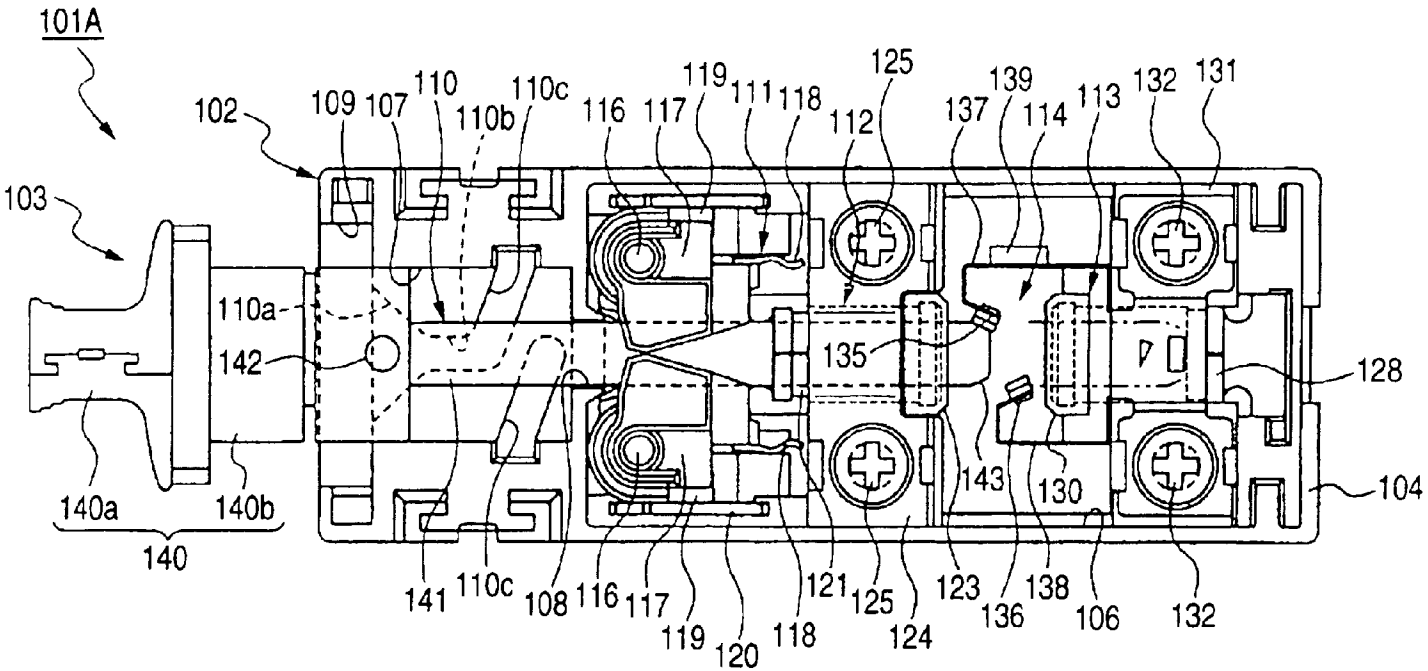
FIG. 7 shows the first embodiment and is an inner face view of the base member showing a state in which the movable plug is brought into contact with a sacrifice electric pole with resistor.

FIGS. 1A through 8 show a first embodiment of the invention. FIG. 1A is a front view of a circuit breaking apparatus 1A. FIG. 1B is a right side view of the circuit breaking apparatus 1A. FIG. 1C is a bottom view of the circuit breaking apparatus 1A. FIG. 2 is an inner face view of a cover 105. FIG. 3 is an inner face view of a base member 104 to which respective terminals and electric pole parts are fixed. FIG. 4 is a sectional view taken along a line A—A of FIG. 1B. FIG. 5 is a front view of a movable plug 103. FIG. 6 is a circuit diagram of a power source circuit mounted with the circuit breaking apparatus 1A. FIG. 7 is an inner face view of the base member 104 showing a state in which the movable plug 103 is brought into contact with a sacrifice terminal with resistor 135. FIG. 8A is an outline view of an essential portion showing a state in which a conductive portion 141 of the movable plug 103 is brought into contact with the sacrifice electric pole 135 with resistor. FIG. 8B is an outline view of the essential portion showing a state in which the conductive portion 141 of the movable plug 103 is brought into contact with a through sacrifice electric pole 136.

As shown in FIG. 1 through FIG. 6, the circuit breaking apparatus 1A is constituted by an apparatus main body 102 and the movable plug 103 capable of being inserted into and drawn from the apparatus main body 102. As shown by FIG. 1, FIG. 3 and FIG. 4 in details, the apparatus main body 102 is constituted by the base member 104 and the cover 105 which are jointed together in a state of butting respective joint faces thereof, and has a shape of a substantially quadrangular prism as a whole. At inside of the apparatus main body 102 in the shape of the quadrangular prism, there are provided a parts containing chamber 106 and a plug inserting chamber 107 along a direction of a center axis C thereof. The parts containing chamber 106 and the plug inserting chamber 107 are communicated with each other via a conductive portion insertion hole 108. The plug inserting chamber 107 and the conductive portion insertion hole 108 are formed in a space in a shape of a circular cylinder centering on the center axis C of the apparatus main body 102. The movable plug 103 is inserted into the space with the center axis C of the apparatus main body 102 as an insertion center axis. A conductive portion 141 of the movable plug 103 is made to advance to the parts containing chamber 106 by passing through the conductive portion insertion hole 108.

One end of the plug inserting chamber 107 is opened to outside and the opened portion thereof constitutes a plug insertion port 109. The movable plug 103 can be inserted into the apparatus main body 102 and the inserted plug 103 can be drawn from the plug insertion port 109. A position at which the movable plug 103 is drawn from the plug insertion port 109 of the apparatus main body 102, constitutes a circuit opened position. A position at which the movable plug 103 is completely inserted into the apparatus main body 103 from the plug insertion port 109, constitutes a circuit closed position. According to the first embodiment, the movable plug 103 is provided movably between the circuit opened position and the circuit closed position by inserting and drawing the conductive portion 141 of the movable plug 103.

The plug insertion port 109 has a diameter slightly larger than a maximum diameter portion of an operating lever 140, mentioned below. The plug inserting chamber 107 is formed by a diameter slightly larger than a circuit cylinder supporting portion 140*b* of the movable plug 103. Two guide grooves 110 for guiding the movable plug 103 at positions opposed to each other by 180 degrees are provided at an inner peripheral face of the plug inserting chamber 107. Each of the guide grooves 110 is constituted by: a projection pickup portion 110*a* having a width several times as large as a projection 142 of the movable plug 103 at an opening position of the plug insertion port 109, the width being gradually narrowed from the plug insertion port 109 toward the deeper side; a guide portion 10*b* for straight advancement communicated with the projection pickup portion 110*a* at a deepest portion thereof, having a constant width to a degree of slightly wider than a width of the projection 142 of the movable plug and extended to the depth side toward a direction of the center axis C of the apparatus main body 102; and a guide portion 110*c* for rotation communicated with the straight advancement guide portion 10*b* at a deepest portion thereof, having a constant width slightly larger than the width of the projection 142 of the movable plug 103 and extended to the depth side in a direction skewed to a direction orthogonal to the center axis C of the apparatus main body 102.

A ground side terminal 111, a load side terminal 112, a sacrifice electrode portion 114, and a power source side terminal 113 are contained in the parts containing chamber 106 in this order from the side of the plug insertion port of the movable plug 103. All of the terminals 111, 112 and 113 and the sacrifice electrode portion 114 are fixed to the base member 104.

The ground side terminal 111 is constituted by: a ground bus bar 115 arranged in a state of being brought into contact with an inner face of the base member 104; a pair of contact portion holders 117 made of insulators rotatably supported by a pair of support pin portions 116 and arranged on the left and on the right with the center axis of the apparatus main body 102 as a boundary; a pair of contact portions 118 fixed to the pair of contact portion holders 117 and brought into contact with the ground bus bar 115 regardless of a rotational position thereof; and a pair of ground springs 119 for urging the pair of contact portion holders 117 to the center side (contact position side) to be brought into contact with each other. That is, as shown by FIG. 3, in a state in which the conductive portion 141 of the movable plug 103 is not inserted between the pair of contact portion holders 117, the pair of contact portion holders 117 are brought into contact with each other by being exerted with spring force of the ground springs 119, and the pair of contact portions 118 are disposed at contact positions in contact with a cylinder ring 121 of the load side terminal 112. As shown by FIG. 7, in a state in which the conductive portion 141 of the movable plug 103 is inserted between the pair of contact portion holders 117, the pair of contact portion holders 118 are rotated in directions a of being separated from each other against the spring force of the respective ground springs 119 by press force of the movable plug 103, and the pair of contact portions 118 are disposed at separated positions separated from the cylinder ring portion 121 of the load side terminal 112. At the contact positions, the ground side terminal 111 and the load side terminal 112 are electrically connected. At the separated positions, the ground side terminal 111 and the load side terminal 112 are electrically broken.

One end side of the ground bus bar 115 is projected from a hole 105*a* of the cover 105 to outside and the projected portion constitutes a ground connection terminal 120. The power source circuit is grounded by using the ground connection terminal 120 (refer to FIG. 6).

The load side terminal 112 is constituted by the cylinder ring portion 111 made of a conductor arranged centering on the center axis C of the apparatus main body 102, a conductive multiple point spring member 122 which is arranged at an inner peripheral face of the cylinder ring portion 121 and elastically deformable in a direction of enlarging a diameter thereof and a resin cap 123 made of an insulator attached to the cylinder ring portion 121 and the multiple point spring member 122 on the side of the sacrifice electrode portion 114. The cylinder ring portion 121 is fixed to the base member 104 by screws 125 via a bracket 124. Further, by inserting the movable plug 103 into the cylinder ring portion 121, the movable plug 103 and the load side terminal 112 are electrically connected. The cylinder ring portion 121 is provided with an extended plate portion, the extended plate is projected to outside from a hole 104*a* of the base member 104 and the projected portion constitutes a load connecting terminal 126. By using the load connecting terminal 126, the load side terminal 121 is electrically connected to a load portion 127 (refer to FIG. 6).

Similar to the load side terminal, the power source side terminal 113 is constituted by a cylinder ring portion 128 made of a conductor arranged centering on the center axis C of the apparatus main body 102, a multiple point contact spring member 129 made of a conductor which is arranged at an inner peripheral face of the cylinder ring portion 128 and elastically deformable in a direction of enlarging a diameter thereof, and a resin cap 130 made of an insulator attached to the cylinder ring portion 128 and the multiple contact spring member 129 on the side of the sacrifice electrode portion 114. The cylinder ring portion 128 is fixed to the base member 104 by screws 132 via a bracket 131. Further, by inserting the movable plug 103 into the cylinder ring portion 128, the movable plug 103 and the power source side terminal 113 are electrically connected. The cylinder ring portion 121 is provided with an extended plate portion, the extended plate portion is projected to outside from a hole 104*b* of the base member 104 and the projected portion constitutes a power source connecting terminal 133. By using the power source connecting terminal 133, the power source side terminal 113 is electrically connected to a power source portion 134 (refer to FIG. 6).

The sacrifice electrode portion 114 is arranged between the load side terminal 112 and the power source side terminal 113 as described above and is constituted by two terminals of the sacrifice electric pole 135 with resistor and the through sacrifice electric pole 136. The sacrifice electric pole 135 with resistor and the through sacrifice electric pole 136 are arranged at positions shifted to the left and to the right separately from the center axis C of the apparatus main body 102. The sacrifice electric pole 135 with resistor is arranged more proximate to the load side terminal 112 than the through sacrifice electric pole 136. The sacrifice electric pole 135 with resistor and the through sacrifice electric pole 136 are supported by respective elastic arm portions 137 and 138 made of a conductor fastened together by the left and right screws 132 for fastening the power source side terminal 113 and are provided movably in directions (b, c arrow mark directions of FIG. 3) further separating from the center axis C of the apparatus main body 102 by elastic deformation of the respective elastic arm portions 137 and 138. A resistor 139 is provided at a middle of the elastic arm portion 137 on the side of the sacrifice electric pole 135 with resistor. The sacrifice electric pole 135 with resistor is electrically connected to the power source side terminal 113 via the resistor 139. The elastic arm portion 138 on the side of the through sacrifice electric pole 136 is not provided with a resistor and the through sacrifice electric pole 136 is electrically connected to the power source side terminal 113 without interposing a resistor therebetween (refer to FIG. 6).

As shown by FIG. 5, the movable plug 103 is constituted by the operating lever 140 and the conductive portion 141 rotatably supported by the operating lever 140. The operating lever 140 is constituted by a handle portion 140*a* which is formed by an insulator of synthetic resin or the like and can be picked up by the finger of the operator and a circular cylinder supporting portion 140*b* provided integrally with the handle portion 140*a* for rotatably supporting the conductive portion 141. The circular cylinder supporting portion 140*b* is provided with the projections 142 at positions opposed to each other by 180 degrees. The conductive portion is formed by a conductive member and is provided with a shape of a slender circular cylindrical rod. A side face 141*a* in the shape of the circular cylindrical rod is extended along the moving direction and is formed with a tapered face 143 a diameter of which is contracted toward a front end thereof at its front end side.

Next, an explanation will be given of circuit operating and closing operation of the power source circuit by the above-described circuit breaking apparatus 1A. A state in which the movable plug 103 is not inserted into the apparatus main body 102, constitutes the circuit opened position of the movable plug 103. When the movable plug 103 at the circuit opened position is inserted from the plug insertion port 109 of the apparatus main body 102 with the front end face of the conductive portion 141 as a head thereof, the conductive portion 141 of the movable plug 103 is made to advance from the conductive portion insertion hole 108 to the parts containing chamber 106 so that the front end face of the conductive portion 141 is firstly brought into contact with the pair of contact point portion holders 117. When the movable plug 103 is inserted against spring force of the pair of arm springs 119 for urging the pair of contact portion holders 117, the pair of contact portion holders 117 are rotated centering on the support pin portions 116 against the spring force of the pair of arm springs 119 to thereby permit insertion of the conductive portion 141 and the pair of contact portions 118 are separated from the cylinder ring portion 121 to thereby electrically break the ground side terminal 111 and the load side terminal 112.

When the movable plug 103 is inserted further from the position, the front end of the conductive portion 141 is inserted into the cylinder ring portion 121 of the load side terminal and the side face 141*a* in a circumferential shape of the conductive portion 141 is brought into contact with the ring-like multiple point contact spring member 122 at inside of the cylinder ring portion 121 in a state of being exerted with elastic force. When the front end of the conductive portion 141 is inserted up to a position of coming out from the cylinder ring portion 121, in the case in which a rotational position of inserting the movable plug 103 is correct, the pair of projections 142 of the operating lever 140 are made to advance to the projection pickup portions 110*a* of the guide grooves 110 of the apparatus main body 102.

When the front end of the conductive portion 141 of the movable plug 103 is made to advance through the cylinder ring portion 121 of the load side terminal 112, as shown by FIG. 7, the front end of the conductive portion 141 is brought into contact with the sacrifice electric pole 135 with resistor. Then, the sacrifice electric pole 135 with resistor and the load side terminal 112 are electrically connected via the conductive portion 141. As a result, the power source portion 134 and the load portion 127 are electrically connected and therefore, current is made to flow from the power source portion 134 to a capacity or the like of the load portion 127, however, only small current is made to flow since the power source portion 134 is connected to the load portion 127 via the resistor 139. That is, abruptly increased current is not made to flow between the conductive portion 141 and the sacrifice electric pole 135 with resistor.

Next, the conductive portion 141 of the movable plug 103 is brought into contact with the through sacrifice electric pole 136. Then, although the power source portion 134 is electrically connected to the load portion 127 directly without interposing a resistor therebetween, since current to some degree flows by previous electricity conduction, abruptly increased current is not made to flow between the conductive portion 141 and the through sacrifice electric pole 136. Further, when the sacrifice electric pole 135 with resistor and the conductive portion 141 are brought into contact with each other and when the through sacrifice electric pole 136 and the conductive portion 141 are brought into contact with each other, there is a possibility of generating arc discharge therebetween, however, a face of the conductive portion 141 which is firstly brought into contact with the sacrifice electric pole 135 with resistor and the through sacrifice electric pole 136, is the tapered face 143 at the front end, so that even if an arc mark remains, the arc mark remains at the tapered face 143 and the arc mark does not remain at the side face 41*a* in the circumferential shape.

When the conductive portion 141 of the movable plug 103 is inserted to a position at which the conductive portion 141 of the movable plug 103 is brought into contact with the pair of electric pole pieces 135 of the sacrifice electrode portion 114, the projections 142 of the movable plug 103 are made to advance to the straight advancement guide portions 110*b* by being guided by the projection pickup portions 110*a* of the guide grooves 110, thereby, the operating lever 140 is disposed at a regular rotational position.

When the movable plug 103 is inserted further and the projections 142 of the movable plug 103 reach the deepest portions of the straight advancement guide portions 110*b*, the operating lever 140*a* is rotated by 180 degrees in the clockwise direction. Then, the projected portions 142 are moved to the deepest portions of the rotation guide portions 110*c* along the rotation guide portions 110*c* and by the rotational movement, the conductive portion 141 of the movable plug 103 is made to advance to the depth side by an amount of a stroke of the rotation guide portions 110*c* in the direction of the center axis. By the stroke, the conductive portion 141 is inserted into the cylinder ring portion 128 of the power source side terminal 113 and the side face 141*a* in the circumferential shape of the conductive portion 141 is brought into contact with the ring-like multiple point contact spring member 129 at inside of the cylinder ring portion 128 in a state of being exerted with elastic force. At this occasion, although the load side terminal 112 and the power source side terminal 113 are brought into contact with each other via the conductive portion 141, since current has already been supplied to a capacitor or the like of the load portion 127 via the sacrifice electrode portion 114 and therefore, arc discharge is not generated.

Figure 10:
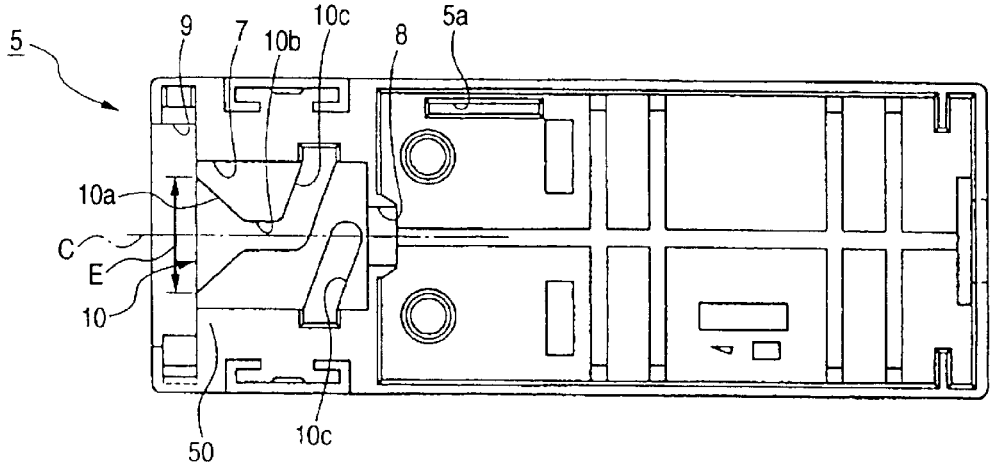
FIG. 10 shows the second embodiment of the invention and is an inner face view of a cover.

Further, as shown in FIG. 10, a position at which the projections 142 of the movable plug 103 are disposed at the deepest portions of the rotation guide portions 110*c*, constitutes the circuit closed position of the movable plug 103 and thereby, operation of inserting the movable plug 103 is finished.

When the movable plug 103 is disposed at the circuit closed position, the movable plug 103 is rotated in the counterclockwise direction by 180 degrees relative to the apparatus main body 102. Thereby, the projections 142 of the movable plug 103 are moved in the rotation guide grooves 110*c* and reach the deepest positions of the straight advancement guide grooves 10*b*. By the rotation, the conductive portion 141 is drawn out from the cylinder ring portion 128 of the power source side terminal 113. Thereby, connection between the power source side terminal 113 and the load side terminal 112 via the conductive portion 141 is broken, however, the interval between the power source portion 134 and the load portion 127 is still connected by the through sacrifice electric pole 136, so that arc discharge is not generated between the conductive portion 141 and the power source side terminal 113.

When the movable plug 103 is further drawn, the conductive portion 141 is disconnected from the through sacrifice electric pole 136 and the sacrifice electric pole 135 with resistor in this order. Although there is a possibility of generating arc discharge when there is a potential difference or the like between the power source portion 134 and the load portion 127, the face of the conductive portion 141 separated from the through sacrifice electric pole 136 and the electric pole with resistor 135, is the tapered face 143 at the front end. Therefore, even if an arc mark remains, the arc mark remains at the tapered face 143 and the arc mark does not remain at the side face 141*a* in the circumferential shape.

When the movable plug 103 is drawn further, the conductive portion 141 is drawn from the cylinder ring portion 121 of the load side terminal 112 and thereafter retreats from between the pair of contact portion holders 117. When the conductive portion 141 is drawn from the pair of contact portion holders 117, the pair of contact portion holders 117 are rotated centering on the respective support pin portions 116 by the spring force of the pair of arm springs 119 and disposed at a position at which the pair of contact portion holders 117 are brought into contact with each other. By rotation of the pair of contact portion holders 117, the pair of contact portions 118 are brought into contact with the cylinder ring portion 121 of the load side terminal 112 and the ground side terminal 111 and the load side terminal 112 are electrically connected. Thereby, large current charged to the capacitor or the like of the load portion 127 is discharged via the load side terminal 112 and the ground side terminal 111.

When the movable plug 103 is drawn further, the movable plug 13 is extracted from the plug insertion port 109 of the apparatus main body 102 to thereby finish operation of extracting the movable plug 103.

As described above, according to the circuit breaking apparatus 1A, when the movable plug 103 is moved from the circuit opened position to the circuit closed position, the conductive portion 141 of the movable plug 103 is brought into contact with the sacrifice electrode portion 114 prior to the power source side terminal 113. When the conductive portion 141 of the movable plug 103 is brought into contact with the sacrifice electrode portion 114, current flows from the power source portion 134 to the load portion 127 via the sacrifice electrode portion 114, electricity flows to the load portion 127. Thereafter, the conductive portion 141 of the movable plug 103 is brought into contact with the power source side terminal 113, so that arc discharge is not generated between the conductive portion 141 of the movable plug 103 and the power source side terminal 113. Further, since terminal parts of the circuit breaking apparatus 1A are constituted only by the power source side terminal 113, the load side terminal 112 and the movable plug 103 for electrically connecting these as well as the sacrifice electrode portion 114, the apparatus is small-sized, inexpensive and capable of preventing melting of terminals by arc discharge without using two relay switches and a control circuit thereof as in the related example.

According to the first embodiment, the sacrifice electrode portion 114 is constituted by the sacrifice electric pole 135 with resistor connected to the power source side terminal 113 via the resistor 139 and the through sacrifice electric pole 136 connected to the power source side terminal directly without interposing a resistor, the sacrifice electric pole 135 with resistor and the through sacrifice electric pole 136 are arranged to shift in the direction of moving the movable plug 103 such that in a procedure of moving the conductive portion 141 of the movable plug 103 from the circuit opened position to the circuit closed position, the conductive portion 141 is firstly brought into contact with the sacrifice electric pole 135 with resistor and thereafter brought into contact with the through sacrifice electric pole 136 and therefore, when the conductive portion 141 of the movable plug 103 is brought into contact with the sacrifice electric pole 135 with resistor, the power source portion 134 is connected to the load portion 127 via the resistor 139 and therefore, only small current is made to flow and abruptly increased current does not flow between the conductive portion 141 and the sacrifice electric pole 135 with resistor, successively, when the conductive portion 141 of the movable plug 103 is brought into contact with the sacrifice electric pole 136, although the power source portion 134 is connected to the load portion 127 directly without interposing a resistor, since current to some degree flows by prior electricity conduction, abruptly increased current does not flow between the conductive portion 141 and the through sacrifice electric pole 136. Therefore, not only arc discharge between the conductive portion 141 of the movable plug 103 and the sacrifice electric pole 135 with resistor and the through sacrifice electric pole 136 constituting the sacrifice terminal 114, can be restrained to a minimum, abruptly increased current does not flow at both of the sacrifice electric pole 135 with resistor and the through sacrifice electric pole 136 constituting the sacrifice electrode portion 114 and promotion of durability of the sacrifice electrode portion 114 can be achieved.

Figure 8A:
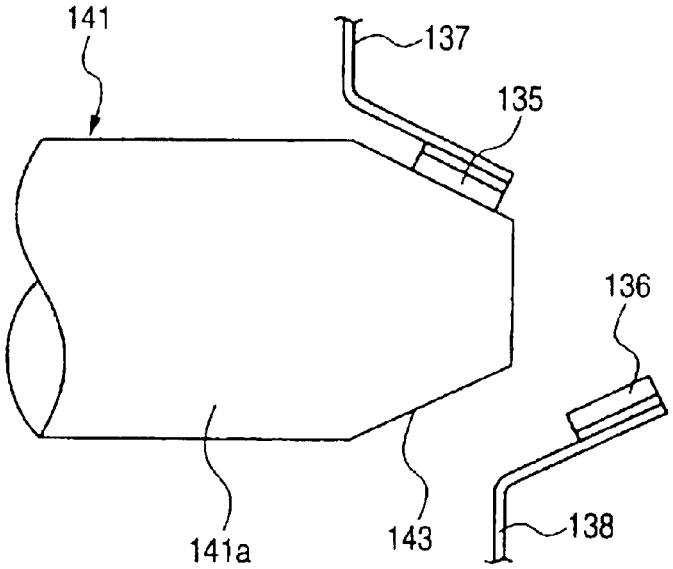
Figure 8B:
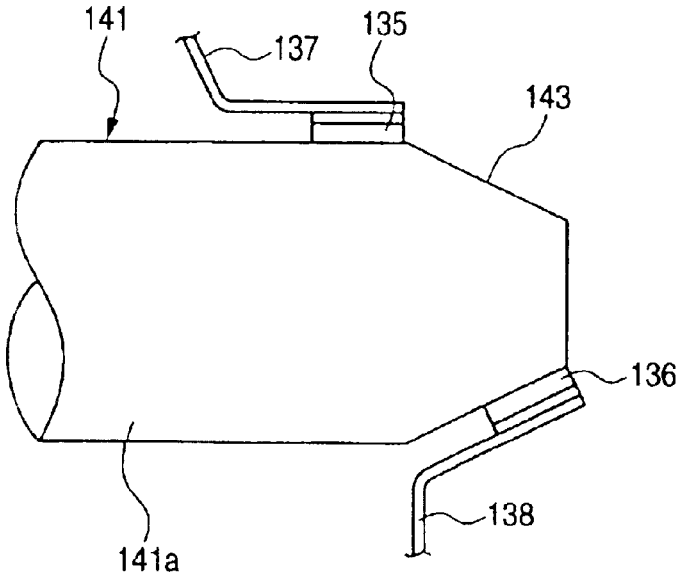

Further, according to the first embodiment, the conductive portion 141 of the movable plug 103 is provided with the tapered face 143 at the front end in the moving direction. Further, in the procedure of inserting the movable plug 103, as shown by FIGS. 8A and 8B, the sacrifice electric pole 135 with resistor and the through sacrifice electric pole 136 of the sacrifice electrode portion 114 are firstly brought into contact with the tapered face 143 and in the procedure of extracting the movable plug 103, the sacrifice electric pole 135 with resistor and the through sacrifice electric pole 135 with resistor and the through sacrifice electric pole 136 of the sacrifice electrode portion 114 are finally separated from the tapered face 143. Therefore, the tapered face 143 of the conductive portion 141 of the movable plug 103 constitutes a face having a possibility of leaving an arc mark, and the side face 141*a* of the conductive portion 141 of the movable plug 103 constitutes a face in contact with the power source side terminal 113. Therefore, the power source side terminal 113 is not brought into contact with the tapered face 143 having the possibility of leaving the arc mark. Therefore, there is provided a stable contact state which is not influenced by the arc mark between the conductive portion 141 of the movable plug 103 and the power source side terminal 113.

Further, according to the circuit breaking apparatus 1A of the first embodiment, what are damaged as terminals by arc discharge, are only the sacrifice electric pole 135 with resistor and the through sacrifice electric pole 136 constituting the sacrifice electrode portion 114. Therefore, durability can be promoted by using a metal having a high melting point, such as copper, silver, tungsten and alloys of these for the sacrifice electric pole 135 with resistor and the through sacrifice electric pole 136 or increasing electric pole capacity by increasing a number of electric poles or enlarging shapes of electric poles in consideration of a magnitude of flowing current or numbers of times of inserting and extracting the movable plug 103.

Further, according to the first embodiment, although the sacrifice electric pole 135 with resistor is provided only at one location, when a plurality of sacrifice electric poles with resistors connected in parallel with each other, a plurality of sacrifice electric poles may be arranged to shift in a direction of the center axis C of the apparatus main body 102 and provided such that the conductive portion 141 of the movable plug 143 is successively brought into contact with the plurality of sacrifice electric poles with resistors, arc discharge can be prevented further effectively.

Second Embodiment

Figure 9A:
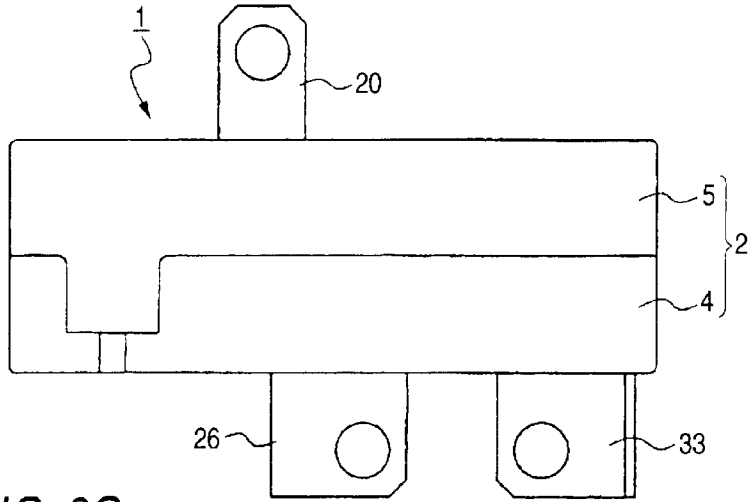
Figure 9C:
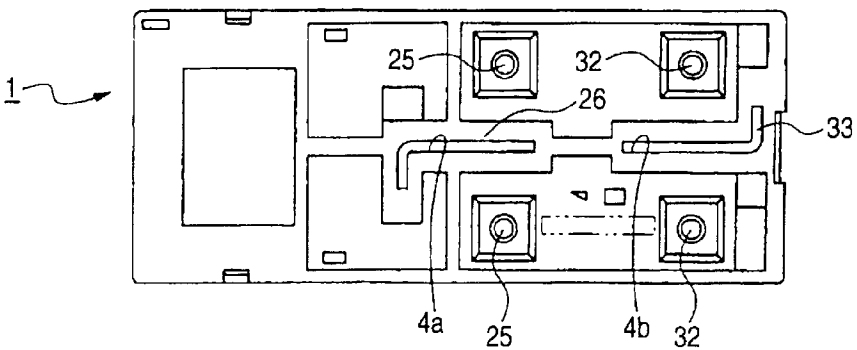
Figure 9B:
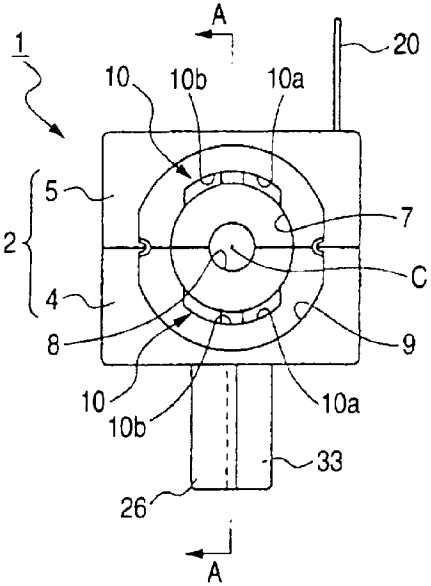
Figure 11:
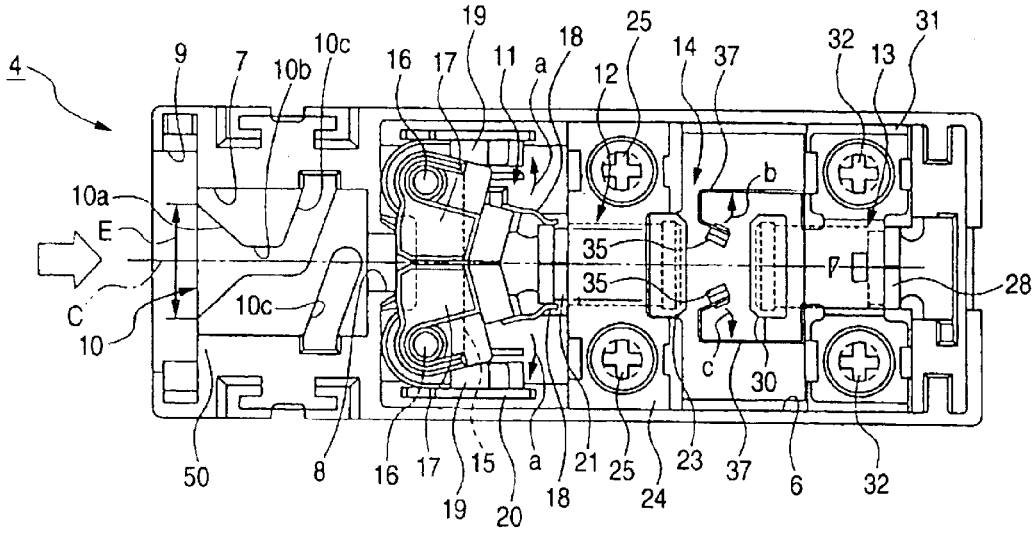
FIG. 11 shows the second embodiment of the invention and is an inner face view of a base member fixed with respective terminals and electric pole parts.
Figure 12:
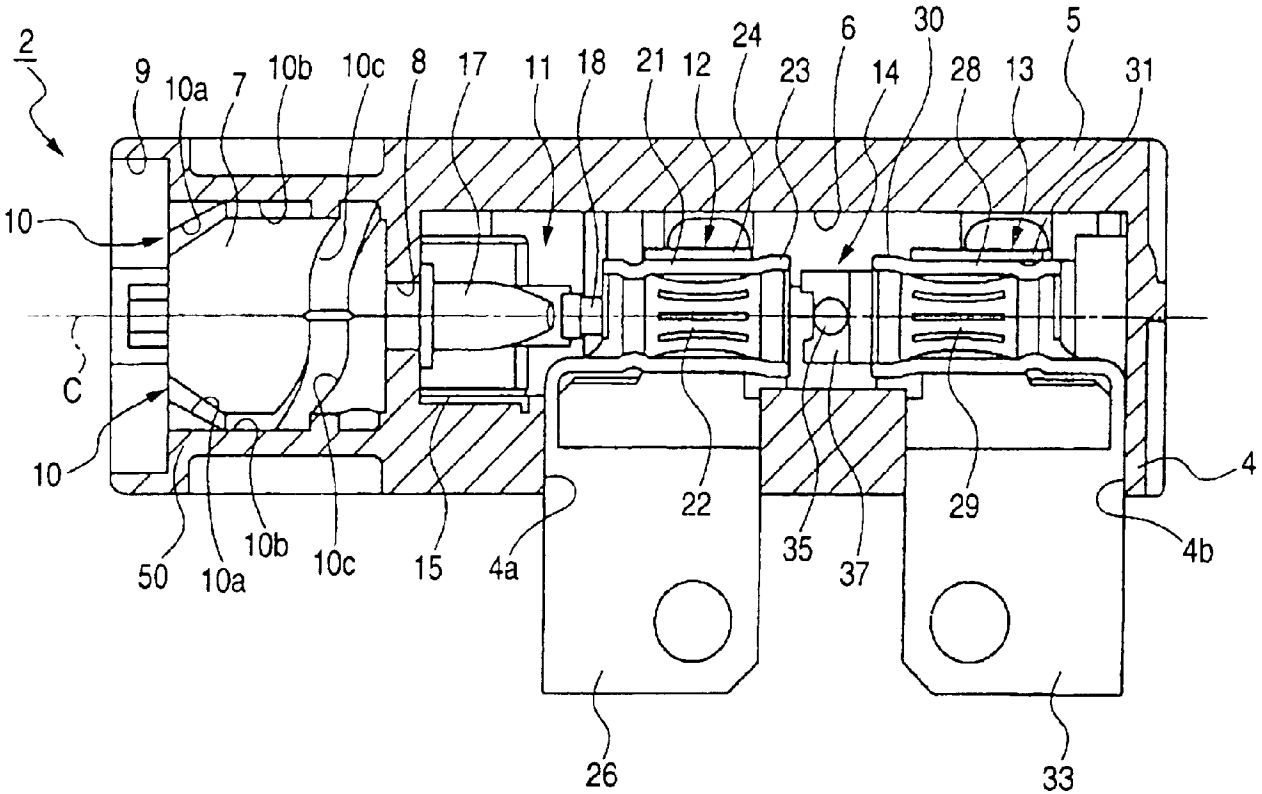
FIG. 12 shows the second embodiment of the invention and is a sectional view taken along a line A—A of FIG. 9B.
Figure 13:
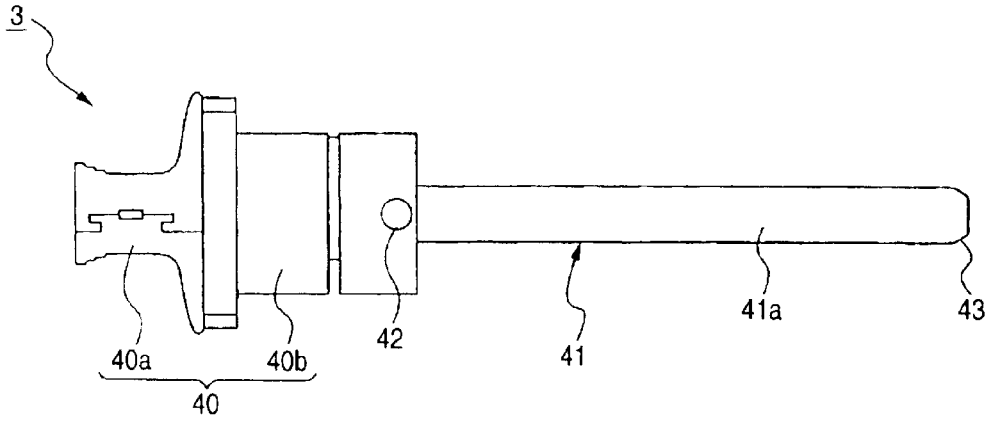
FIG. 13 shows the second embodiment of the invention and is a front view of a movable plug.
Figure 14:
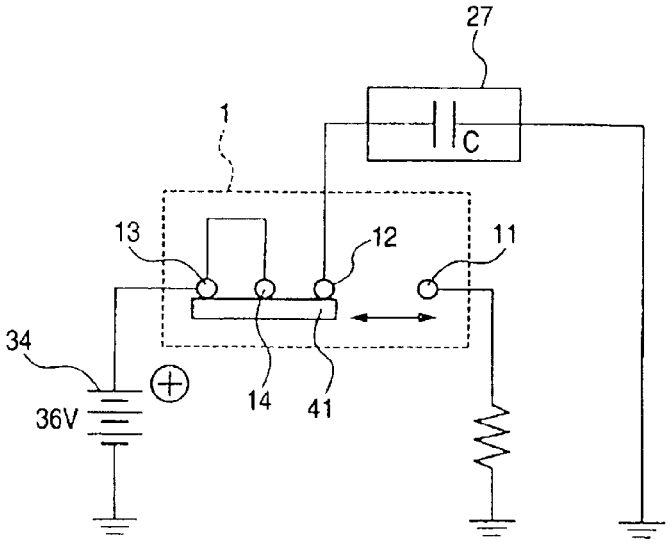
FIG. 14 shows the second embodiment of the invention and is a circuit diagram of a power source circuit mounted with the circuit breaking apparatus.
Figure 15:
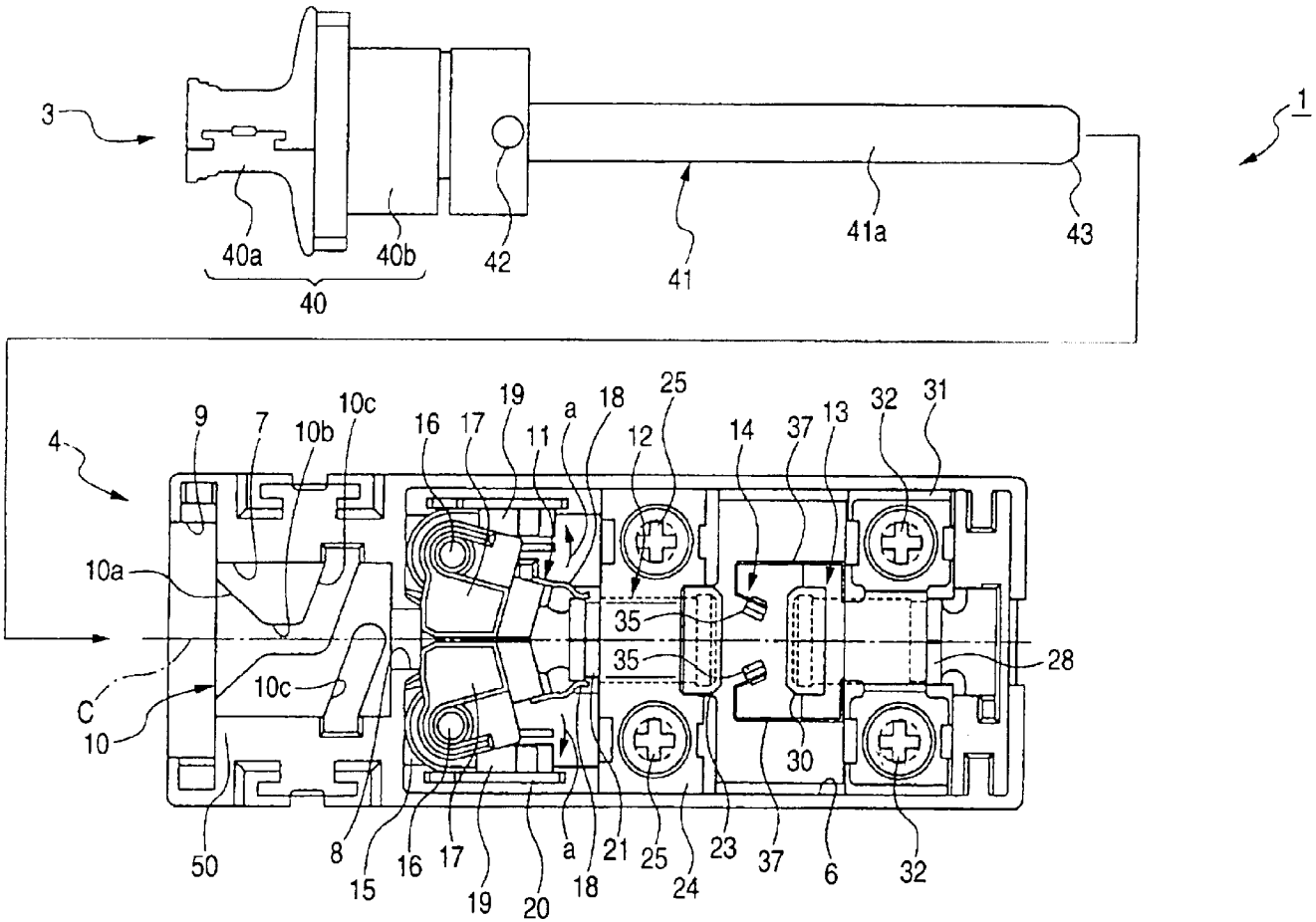
FIG. 15 shows the second embodiment of the invention and is an inner face view of the base member showing a state in which a movable plug is disposed at a circuit opened position.
Figure 16:
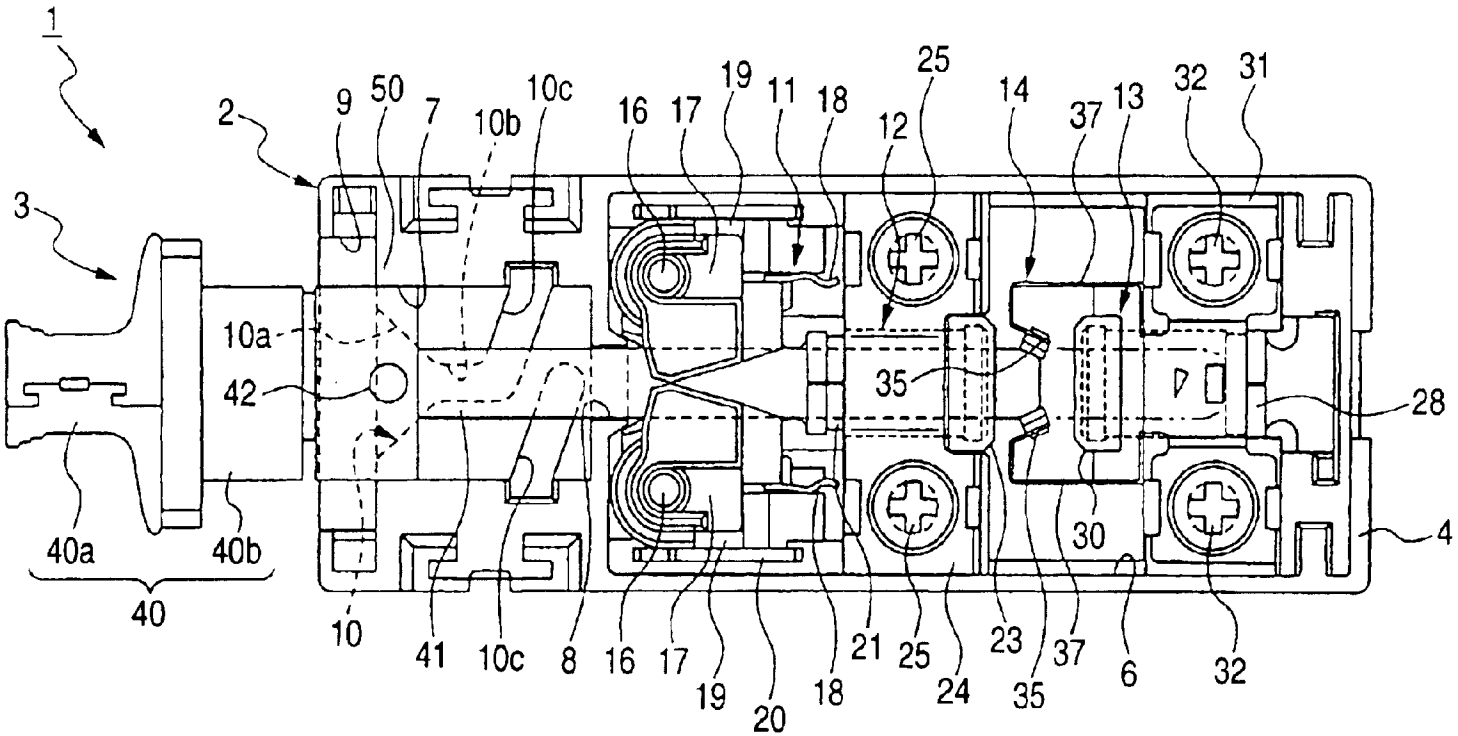
FIG. 16 shoes the second embodiment of the invention and is an inner face view of the base member showing a state in which a conductive portion of the movable plug is brought into contact with a sacrifice electric pole.
Figure 17:
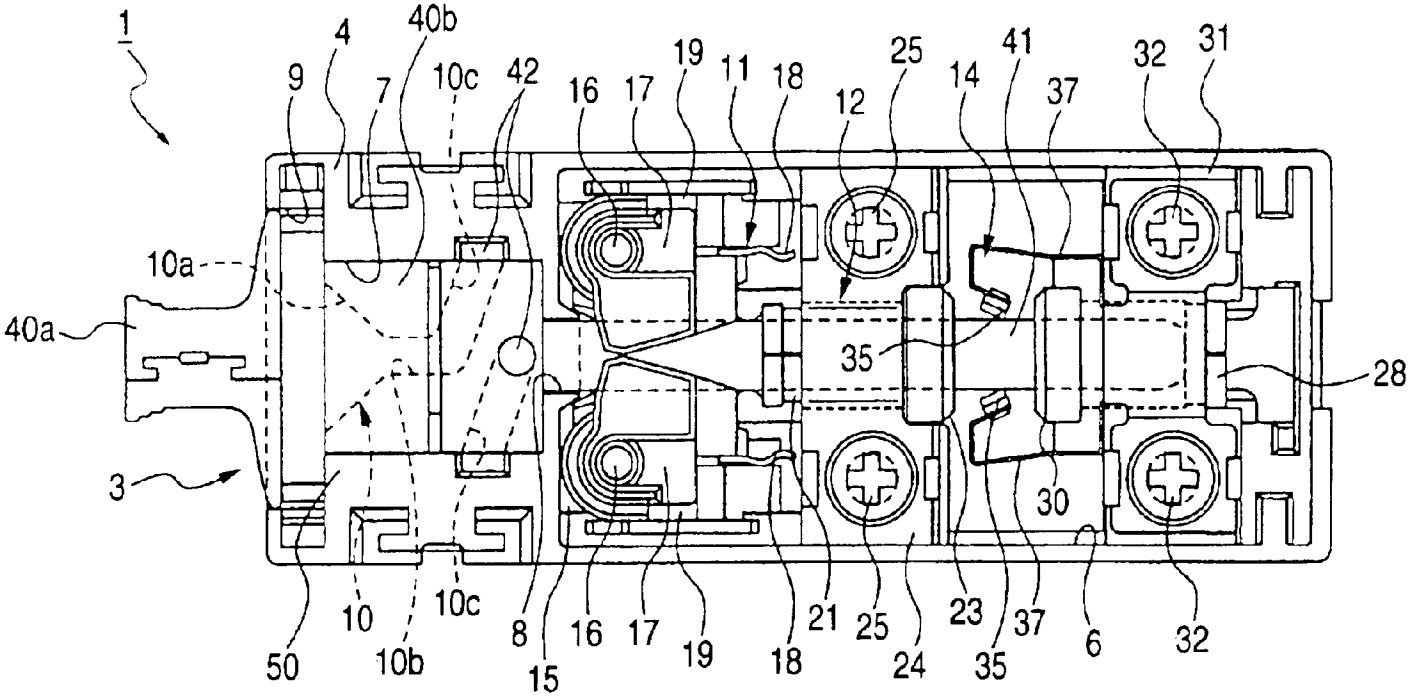
FIG. 17 shows the second embodiment of the invention and is an inner face view of the base member showing a state in which the conductive portion of the movable plug is disposed at a circuit closed position.
Figure 18A:
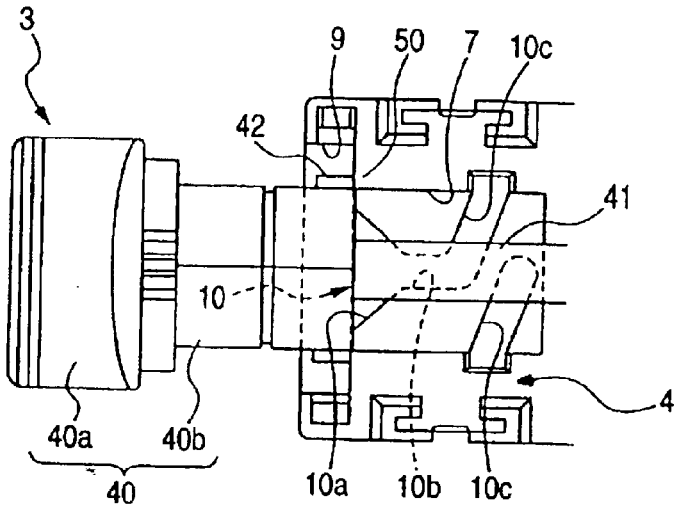
Figure 18B:
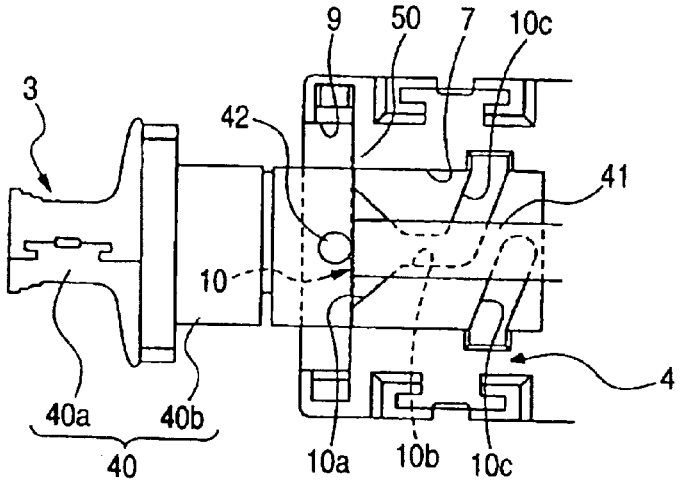
Figure 18C:
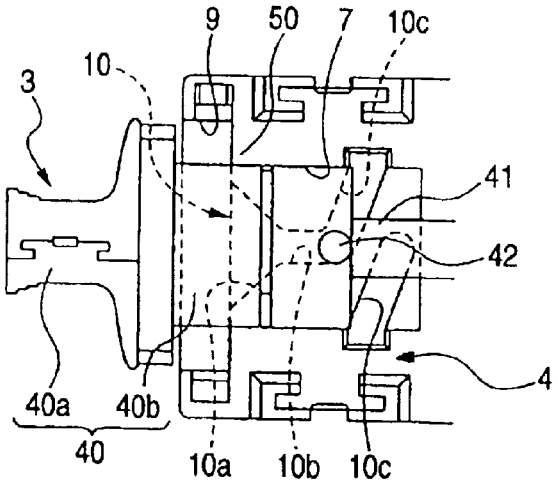
Figure 19:
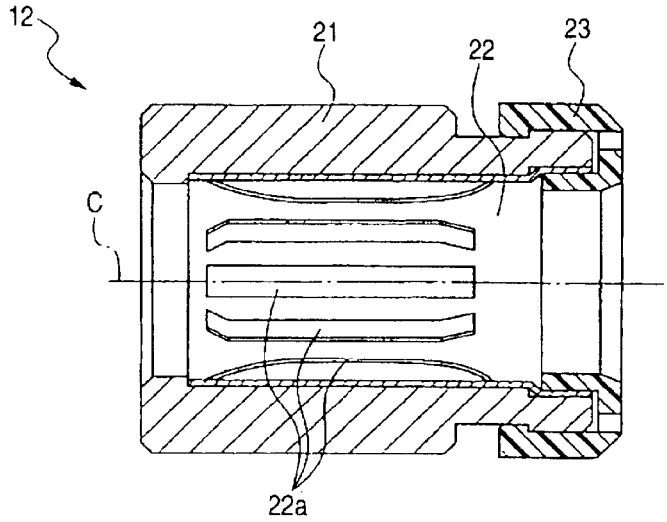
FIG. 19 shows the second embodiment of the invention and is a sectional view of a load side terminal.

FIGS. 9A through 19 show a second embodiment of the invention. FIG. 9A is a front view of a circuit breaking apparatus 1. FIG. 9B is a right side view of the circuit breaking apparatus 9A. FIG. 9C is a bottom view of the circuit breaking apparatus 9A. FIG. 10 is an inner face view of a cover 5. FIG. 11 is an inner face view of a base member 4 to which respective terminals and electric pole parts are fixed. FIG. 12 is a sectional view taken along a line A—A of FIG. 9B. FIG. 13 is a front view of a movable plug 3. FIG. 14 is a circuit diagram of a power source circuit mounted with the circuit breaking apparatus 1. FIG. 15 is an inner face view of the base member showing a state in which the movable plug is disposed at a circuit opened position. FIG. 16 is an inner face view of the base member showing a state in which a conductive portion of the movable plug is brought into contact with a sacrifice electric pole. FIG. 17 is an inner face view of the base member showing a state in which the conductive portion of the movable plug is disposed at a circuit closed position. FIG. 18A is a sectional view of an essential portion of the circuit breaking apparatus showing a state in which the movable plug is inserted (erroneously inserted) at other than a regular rotational position. FIG. 18B is a sectional view of the essential portion of the circuit breaking apparatus showing a state in which the movable plug is inserted at the regular rotational position. FIG. 18C is a sectional view of the essential portion of the circuit breaking apparatus showing a state in which projections of the movable plug are inserted up to deepest positions of a guide portion for straight advancement. FIG. 19 is a sectional view of a load side terminal.

As shown in FIG. 9 through FIG. 14, the circuit breaking apparatus 1 is constituted by an apparatus main body 2 and the movable plug 3 capable of being inserted into and drawn from the apparatus main body 2. As shown by FIG. 9, FIG. 11 and FIG. 12 in details, the apparatus main body 2 is constituted by the synthetic resin base member 4 and the synthetic resin cover 5 which are jointed together in a state of butting respective joint faces thereof, and has a shape of a substantially quadrangular prism as a whole. At inside of the apparatus main body 2 in the shape of the quadrangular prism, there are provided a parts containing chamber 6 and a plug inserting chamber 7 along a direction of a center axis C thereof. The parts containing chamber 6 and the plug inserting chamber 7 are communicated with each other via a conductive portion insertion hole 8. The plug inserting chamber 7 and the conductive portion insertion hole 8 are formed in a space in a shape of a circular cylinder centering on the center axis C of the apparatus main body 2. The movable plug 3 is inserted into the space with the center axis C of the apparatus main body 2 as an insertion center axis. A conductive portion 41 of the movable plug 3 is made to advance to the parts containing chamber 6 by passing through the conductive portion insertion hole 8.

One end of the plug inserting chamber 7 is opened to outside and the opened portion thereof constitutes a plug insertion port 9. The movable plug 3 can be inserted into the apparatus main body 2 and the inserted plug 3 can be drawn from the plug insertion port 9. A position at which the movable plug 3 is drawn from the plug insertion port 9 of the apparatus main body 2, constitutes a circuit opened position. A position at which the movable plug 3 is completely inserted into the apparatus main body 3 from the plug insertion port 9, constitutes a circuit closed position. According to the second embodiment, the movable plug 3 is provided movably between the circuit opened position and the circuit closed position by inserting and drawing the conductive portion 41 of the movable plug 3.

The plug insertion port 9 has a diameter slightly larger than a maximum diameter portion of an operating lever 40, mentioned below. The plug inserting chamber 7 is formed by a diameter slightly larger than a circuit cylinder supporting portion 40*b* of the movable plug 3. Two guide grooves 10 for guiding the movable plug 3 at positions opposed to each other by 180 degrees are provided at an inner peripheral face of the plug inserting chamber 7. Each of the guide grooves 10 is constituted by: a projection pickup portion 10*a* having a width several times (preferably three to six times) as large as a projection 42 of the movable plug 3 at an opening position of the plug insertion port 9, the width being gradually narrowed from the plug insertion port 9 toward the deeper side; a guide portion 10*b* for straight advancement communicated with the projection pickup portion 10*a* at a deepest portion thereof, having a constant width to a degree of slightly wider than a width of the projection 42 of the movable plug 3 and extended to the depth side toward a direction of the center axis C of the apparatus main body 2; and a guide portion 10*c* for rotation communicated with the straight advancement guide portion 10*b* at a deepest portion thereof, having a constant width slightly larger than the width of the projection 42 of the movable plug 3 and extended to the depth side in a direction skewed to a direction orthogonal to the center axis C of the apparatus main body 2. In inserting the movable plug 3 into the apparatus main body 2, when the projections 42 of the movable plug 3 are disposed at inside of an opening area (E area of FIG. 10 and FIG. 11) of the projection pickup portions on the side of the plug insertion port 9, insertion of the movable plug 3 is permitted, and when the projections 42 of the movable plug 3 are disposed outside of the opening area (E area of FIG. 10 and FIG. 11), insertion of the movable plug 3 is prevented. A section of moving the projections 42 of the movable plug 3 at inside of the guide portions 10*c* for rotation, is provided in correspondence with an insertion section in which the conductive portion 41 of the movable plug 3 is brought into contact with the power source side terminal 13 disposed on an insertion depth side of the apparatus main body 2.

A ground side terminal 11, a load side terminal 12 (load device side fixed electric pin), a sacrifice electrode portion 14 (power source side fixed electric pin), and a power source side terminal 13 are contained in the parts containing chamber 6 in this order from the side of the plug insertion port of the movable plug 3. All of the terminals 11, 12 and 13 and the sacrifice electrode portion 14 are fixed to the base member 4.

The ground side terminal 11 is constituted by: a ground bus bar 15 arranged in a state of being brought into contact with an inner face of the base member 4; a pair of contact portion holders 17 made of insulators rotatably supported by a pair of support pin portions 16 and arranged on the left and on the right with the center axis of the apparatus main body 2 as a boundary; a pair of contact portions 18 fixed to the pair of contact portion holders 17 and brought into contact with the ground bus bar 15 regardless of a rotational position thereof; and a pair of ground springs 19 for urging the pair of contact portion holders 17 to the center side to be brought into contact with each other. That is, as shown in FIGS. 11 and 15, in a state in which the conductive portion 41 of the movable plug 3 is not inserted between the pair of contact portion holders 17, the pair of contact portion holders 17 are brought into contact with each other by being exerted with spring force of the ground springs 19, and the pair of contact portions 18 are disposed at contact positions in contact with a cylinder ring 21 of the load side terminal 12.

The ground side terminal 11 is constituted by: a ground bus bar 15 arranged in a state of being brought into contact with an inner face of the base member 4; a pair of contact portion holders 17 made of insulators rotatably supported by a pair of support pin portions 16 and arranged on the left and on the right with the center axis of the apparatus main body 2 as a boundary; a pair of contact portions 18 fixed to the pair of contact portion holders 17 and brought into contact with the ground bus bar 15 regardless of a rotational position thereof; and a pair of ground springs 19 (urging member) for urging the pair of contact portion holders 17 to the center side (contact position side) to be brought into contact with each other. That is, as shown in FIGS. 11 and 15, in a state in which the conductive portion 41 of the movable plug 3 is not inserted between the pair of contact portion holders 17, the pair of contact portion holders 17 are brought into contact with each other and positioned at a locus of the conductive portion 41 of the movable plug 3 by being exerted with spring force of the ground springs 19, and the pair of contact portions 18 are disposed at contact positions in contact with a cylinder ring 21 of the load side terminal 12. As shown in FIGS. 16 and 9, in a state in which the conductive portion 41 of the movable plug 3 is inserted between the pair of contact portion holders 17, the pair of contact portion holders 18 are rotated in directions a of being separated from each other against the spring force of the respective ground springs 19 by press force of the movable plug 3 and positioned at a position where the conductive portion 41 of the movable plug 3 can slide (outside of the locus of the conductive portion 41), and the pair of contact portions 18 are disposed at separated positions separated from the cylinder ring portion 21 of the load side terminal 12. At the contact positions, the ground side terminal 11 and the load side terminal 12 are electrically connected. At the separated positions, the ground side terminal 11 and the load side terminal 12 are electrically broken.

One end side of the ground bus bar 15 is projected from a hole 5*a* of the cover 5 to outside and the projected portion constitutes a ground connection terminal 20. The power source circuit is grounded by using the ground connection terminal 20 (refer to FIG. 14).

As shown in FIG. 19 in detail, the load side terminal 12 as first terminal is constituted by the cylinder ring portion 11 made of a conductor arranged centering on the center axis C of the apparatus main body 2, a conductive multiple point spring member 22 which has a plurality of spring portions and is arranged at an inner peripheral face of the cylinder ring portion 21 and elastically deformable in a direction of enlarging a diameter thereof and a resin cap 23 made of an insulator attached to the cylinder ring portion 21 and the multiple point spring member 22 on the side of the sacrifice electrode portion 14. The resin cap 23 is provided to as to cover a distal end of the cylindrical ring portion 21 and the multiple point spring member 22. The multiple point contact spring member 22 is fixed to the cylinder ring portion 21 by the resin cap 23. The cylinder ring portion 21 is fixed to the base member 4 by screws 25 via a bracket 24. Further, by inserting the movable plug 3 into the cylinder ring portion 21, the movable plug 3 and the load side terminal 12 are electrically connected. The cylinder ring portion 21 is provided with an extended plate portion, the extended plate is projected to outside from a hole 4*a* of the base member 4 and the projected portion constitutes a load connecting terminal 26. By using the load connecting terminal 26, the load side terminal 21 is electrically connected to a load portion 27 (load device) (refer to FIG. 14).

Similar to the load side terminal 12, the power source side terminal 13 as a second terminal is constituted by a cylinder ring portion 28 made of a conductor arranged centering on the center axis C of the apparatus main body 2, a multiple point contact spring member 29 made of a conductor which has a plurality of spring portions and is arranged at an inner peripheral face of the cylinder ring portion 28 and elastically deformable in a direction of enlarging a diameter thereof, and a resin cap 30 made of an insulator attached to the cylinder ring portion 28 and the multiple contact spring member 29 on the side of the sacrifice electrode portion 14. The resin cap 30 is provided to as to cover a distal end of the cylindrical ring portion 28 and the multiple point spring member 29. The multiple point contact spring member 29 is fixed to the cylinder ring portion 28 by the resin cap 30. The cylinder ring portion 28 is fixed to the base member 4 by screws 32 via a bracket 31. Further, by inserting the movable plug 3 into the cylinder ring portion 28, the movable plug 3 and the power source side terminal 13 are electrically connected. The cylinder ring portion 21 is provided with an extended plate portion, the extended plate portion is projected to outside from a hole 4*b* of the base member 4 and the projected portion constitutes a power source connecting terminal 33. By using the power source connecting terminal 33, the power source side terminal 13 is electrically connected to a power source portion 34 (refer to FIG. 14).

The sacrifice electrode portion 14 is constituted by a pair of left and right electric piece portions 35, 35 arranged between the load side terminal 12 and the power source side terminal 13 as described above and arranged at positions shifted from each other on the left and on the right separately from the center axis C of the apparatus main body 2. The pair of electric pole pieces portions 35, 35 are supported by respective elastic arm portions 37 made of a conductor fastened together by left and right screws 32 for fastening the power source side terminal 13 and provided movably in directions (arrow marks b, c directions of FIG. 11) further separating from the center axis C of the apparatus main body 2 by elastic deformation of the respective elastic arm portions 37. The pair of electric pole piece portions 35, 35 are electrically connected to the power source side terminal 13 without interposing resistors therebetween (refer to FIG. 14).

As shown by FIG. 13, the movable plug 3 is constituted by the operating lever 40 and the conductive portion 41 rotatably supported by the operating lever 40. The operating lever 40 is constituted by a handle portion 40*a* which is formed by an insulator of synthetic resin or the like and can be picked up by the finger of the operator and a circular cylinder supporting portion 40*b* provided integrally with the handle portion 40*a* for rotatably supporting the conductive portion 41. The circular cylinder supporting portion 40*b* is provided with the projections 42 at positions opposed to each other by 180 degrees. The conductive portion is formed by a conductive member and is provided with a shape of a slender circular cylindrical rod. A side face 41*a* in the shape of the circular cylindrical rod is extended along the moving direction and is formed with a tapered face 43 a diameter of which is contracted toward a front end thereof at its front end side.

Next, an explanation will be given of circuit operating and closing operation of the power source circuit by the above-described circuit breaking apparatus 1A. As shown in FIG. 15, a state in which the movable plug 3 is not inserted into the apparatus main body 2, constitutes the circuit opened position of the movable plug 3. When the movable plug 3 at the circuit opened position is inserted from the plug insertion port 9 of the apparatus main body 2 with the front end face of the conductive portion 41 as a head thereof, the conductive portion 41 of the movable plug 3 is made to advance from the conductive portion insertion hole 8 to the parts containing chamber 6 so that the front end face of the conductive portion 41 is firstly brought into contact with the pair of contact point portion holders 17. When the movable plug 3 is inserted against spring force of the pair of arm springs 19 for urging the pair of contact portion holders 17, the pair of contact portion holders 17 are rotated centering on the support pin portions 16 in a direction of an arrow a in FIG. 11 against the spring force of the pair of arm springs 19 to thereby permit insertion of the conductive portion 41 and the pair of contact portions 18 are separated from the cylinder ring portion 21 to thereby electrically break the ground side terminal 11 and the load side terminal 12.

When the movable plug 3 is inserted further from the position, the front end of the conductive portion 41 is inserted into the cylinder ring portion 21 of the load side terminal and the side face 41*a* in a circumferential shape of the conductive portion 41 is brought into contact with the ring-like multiple point contact spring member 22 at inside of the cylinder ring portion 21 in a state of being exerted with elastic force. When the front end of the conductive portion 41 is inserted up to a position of coming out from the cylinder ring portion 21, in the case in which the movable plug 3 is inserted at a rotational position of permitting insertion to the apparatus main body 2 (a position at which the projections 42 of the movable plug 3 enter the E area of FIG. 10 and FIG. 11), as shown in FIG. 18B, the pair of projections 42, 42 of the operation lever 40 are made to advance to the projection pickup portions 10*a* of the guide grooves 10. When the movable plug 3 is inserted at a rotational position of hampering insertion to the apparatus main body 2 (position at which the projections 42 of the movable plug 3 do not enter the E area of FIG. 10 and FIG. 11), that is, when the movable plug 3 is erroneously inserted, as shown by FIG. 18A, the pair of projections 42, 42 of the operation lever 40 do not advance to the projection pickup portions 10*a* of the guide grooves 10 of the apparatus main body 2 but interfere with the opening wall portion 50 of the plug inserting chamber 7 of the apparatus main body 2 and further insertion of the movable plug 3 is prohibited.

In the case in which the movable plug 3 is inserted at the rotational position of permitting insertion, when the front end of the conductive portion 41 of the movable plug 3 advances through the cylinder ring portion 21 of the load side terminal 12, as shown by FIG. 16, the front end of the conductive portion 41 is brought into contact with the electric pole piece portions 35 of the sacrifice electrode portion 14. Then, the power source portion (battery) 34 and the load portion 27 are electrically connected and therefore, current is made to flow from the power source portion 34 to a capacity or the like of the load portion 27. Further, when the sacrifice electrode portion 14 and the conductive portion 41 are brought into contact with each other, there is a possibility of generating arc discharge therebetween. Since a face of the conductive portion 41 firstly brought into contact with the pair of electric pole piece portions 35, 35 of the sacrifice electrode portion 14, is the tapered face 43 of the front end and therefore, if an arc mark remains, the arc mark remains at the tapered face 43 and the arc mark does not remain at the side face 41*a* in the circumferential shape.

When the conductive portion 41 of the movable plug 3 is inserted to a position at which the conductive portion 41 of the movable plug 3 is brought into contact with the pair of electric pole pieces 35 of the sacrifice electrode portion 14, the projections 42 of the movable plug 3 are made to advance to the straight advancement guide portions 10*b* by being guided by the projection pickup portions 10*a* of the guide grooves 10, thereby, the operating lever 40 is disposed at a regular rotational position.

As show in FIG. 18C, when the movable plug 3 is inserted further and the projections 42 of the movable plug 3 reach the deepest portions of the straight advancement guide portions 10*b*, the operating lever 40*a* is rotated by 180 degrees in the clockwise direction. Then, the projected portions 42 are moved to the deepest portions of the rotation guide portions 10*c* along the rotation guide portions 10*c* and by the rotational movement, the conductive portion 41 of the movable plug 3 is made to advance to the depth side by an amount of a stroke of the rotation guide portions 10*c* in the direction of the center axis. By the stroke, the conductive portion 41 is inserted into the cylinder ring portion 28 of the power source side terminal 13 and the side face 41*a* in the circumferential shape of the conductive portion 41 is brought into contact with the ring-like multiple point contact spring member 29 at inside of the cylinder ring portion 28 in a state of being exerted with elastic force. At this occasion, although the load side terminal 12 and the power source side terminal 13 are brought into contact with each other via the conductive portion 41, since current has already been supplied to a capacitor or the like of the load portion 27 via the sacrifice electrode portion 14 and therefore, arc discharge is not generated.

Further, as shown in FIG. 18C, a position at which the projections 42 of the movable plug 3 are disposed at the deepest portions of the rotation guide portions 10*c*, constitutes the circuit closed position of the movable plug 3 and thereby, operation of inserting the movable plug 3 is finished.

When the movable plug 3 is disposed at the circuit closed position, the movable plug 3 is rotated in the counterclockwise direction by 180 degrees relative to the apparatus main body 2. Thereby, the projections 42 of the movable plug 3 are moved in the rotation guide grooves 10*c* and reach the deepest positions of the straight advancement guide grooves 10*b*. By the rotation, the conductive portion 41 is drawn out from the cylinder ring portion 28 of the power source side terminal 13. Thereby, connection between the power source side terminal 13 and the load side terminal 12 via the conductive portion 41 is broken, however, the interval between the power source portion 34 and the load portion 27 is still connected by the through sacrifice electric pole 36, so that arc discharge is not generated between the conductive portion 41 and the power source side terminal 13.

Next, when the movable plug 3 is drawn from the apparatus main body 2, the conductive portion 41 and the pair of electric pole piece portions 35, 35 of the sacrifice electrode portion 14 are disconnected. Further, there is a possibility of generating arc discharge when there is a potential difference or the like between the power source portion 34 and the load portion 27. since the face of the conductive portion 41 separated from the sacrifice electrode portion 14, is the tapered face 43 at the front end and therefore, if an arc mark remains, the arc mark remains at the tapered face 43 and the arc mark does not remain at the side face 41*a* in the circumferential shape.

When the movable plug 3 is drawn further, the conductive portion 41 is drawn from the cylinder ring portion 21 of the load side terminal 12 and thereafter retreats from between the pair of contact portion holders 17. When the conductive portion 41 is drawn from the pair of contact portion holders 17, the pair of contact portion holders 17 are rotated centering on the respective support pin portions 16 by the spring force of the pair of arm springs 19 and disposed at a position at which the pair of contact portion holders 17 are brought into contact with each other. By rotation of the pair of contact portion holders 17, the pair of contact portions 18 are brought into contact with the cylinder ring portion 21 of the load side terminal 12 and the ground side terminal 11 and the load side terminal 12 are electrically connected. Thereby, large current charged to the capacitor or the like of the load portion 27 is discharged via the load side terminal 12 and the ground side terminal 11.

When the movable plug 3 is drawn further, the movable plug 3 is extracted from the plug insertion port 9 of the apparatus main body 2 to thereby finish operation of extracting the movable plug 3.

According to the circuit breaking apparatus 1A of the second embodiment, similar to the first embodiment, when the movable plug 3 is moved from the circuit opened position to the circuit closed position, the conductive portion 41 of the movable plug 3 is brought into contact with the through sacrifice electric poles 45 prior to the power source side terminal 13. When the conductive portion 41 of the movable plug 3 is brought into contact with the through sacrifice electric poles 45, current flows from the power source portion 34 to the load portion 27 via the through sacrifice electric poles 45. After electricity flows to the load portion 27, the conductive portion 41 of the movable plug 3 is brought into contact with the power source side terminal 13. Therefore, arc discharge is not generated between the conductive portion 41 of the movable plug 3 and the power source side terminal 13. Further, terminal parts of the circuit breaking apparatus 1 are constituted only by the power source side terminal 13, the load side terminal 12 and the movable plug 3 for electrically connecting these as well as the through sacrifice electric poles 45. Therefore, the apparatus is small sized, inexpensive and capable of preventing melting of terminals by arc discharge without using two relay switches and a control circuit thereof as in the related example.

Further, according to the second embodiment, the tapered face 43 is provided at the front end of the conductive portion 41 of the movable plug 3. In the procedure of inserting the movable plug 3, as shown by FIG. 13, the through sacrifice electric poles 45 are firstly brought into contact with tapered face 43 and in the procedure of extracting the movable plug 3, the through sacrifice electric poles 45 are finally separated from the tapered face 43. The tapered face 43 at the front end of the conductive portion 41 of the movable plug 3 constitutes the face having a possibility of leaving an arc mark, and the side face 41*a* of the conductive portion 41 of the movable plug 3 constitutes the face with which the power source side terminal 13 is brought into contact. Therefore, the power source side terminal 13 is not brought into contact with the tapered face 43 having the possibility of leaving the mark and therefore, there is provided a stable contact state which is not influenced by the arc mark between the conductive portion 41 of the movable plug 3 and the power source side terminal 13.

According to the second embodiment, since the sacrifice electrode portion 14 is provided only with the through sacrifice electric poles 45 connected to the power source side terminal 13 directly without interposing resistors and therefore, the sacrifice electric poles 14 may simply be connected electrically through to the power source side terminal 13 and therefore, the constitution is simple.

According to the circuit breaking apparatus 1 of the second embodiment, what is damaged as a terminal by arc discharge, is only the through sacrifice electric pole 45 constituting the sacrifice electrode portion 14 and therefore, durability can be promoted by using a metal having a high melting point of copper, silver, tungsten and alloys of these for the through sacrifice electric pole 45 or increasing electric pole capacity by increasing a number of electric poles or enlarging shapes of electric poles in consideration of a magnitude of conducted current or numbers of times of inserting and extracting the movable plug 3.

Further, according to the second embodiment, the pair of through sacrifice electric poles 45 are arranged at the same position which are not shifted from each other with respect to the center axis direction (direction of inserting the movable plug 3) of the apparatus main body 2. Therefore, the pair of through sacrifice electric poles 45 are simultaneously brought into contact with the conductive portion 41 of the movable plug 3, so that the electric pole capacity is large which contributes to promotion of durability.

As described above, according to the circuit breaking apparatus 1, by simply inserting the movable plug 3 into the apparatus main body 2, the load side terminal 12 can be conducted to and broken from the power source side terminal 13. Therefore, it is unnecessary to separately provide an operating lever member as in the related example and the circuit breaking apparatus 1 can be made compact. Further, when the movable plug 3 is going to be inserted into the apparatus main body 2 at a rotational position thereof relative to the apparatus main body 2 other than the regular position, the projections 42 are not started into the guide grooves 10 but are brought into contact with the opening wall portion 50 to thereby prohibit insertion. On the other hand, when the movable plug 3 is inserted into the apparatus main body 2 at a rotational position thereof relative to the apparatus main body 2 constituting the regular position, the projections 42 are inserted into the guide grooves 10 to thereby enable to permit insertion. Therefore, the movable plug 3 is inserted thereinto only at the rotational position of the movable plug 3 constituting the regular rotational position, thereby, erroneous insertion of the movable plug 3 can be prevented.

According to the second embodiment, the load side terminal 12 and the power source side terminal 13 are respectively provided with the cylinder ring shape, the conductive portion 41 of the movable plug 3 is provided with the shape of the circular cylinder rod inserted into the cylinder ring shape, the conductive portion 41 of the movable plug 3 is electrically connected to the load side terminal 12 and the power source side terminal 13 by being inserted thereinto. Therefore, the conductive portion 41 of the movable plug 3 and the load side terminal 12 and the power source side terminal 13 are brought into contact with each other over entire faces thereof in the circumferential shape and therefore, so that the stable contact state is achieved.

In the portion of the guide groove 10 at the section in correspondence with the insertion section in which the conductive portion 41 of the movable portion 3 is brought into contact with the power source side terminal 13 disposed on the insertion depth side of the apparatus main body 2, the guide portion 10*c* for rotation extended to the depth side in the direction skewed to the direction orthogonal to the direction of inserting the movable plug 3 is provided. Therefore, when the movable plug 3 is rotated, the projection 42 is moved in the guide portion 10*c* for rotation of the guide groove 10 by the rotational force, the conductive portion 41 is inserted into the power source side terminal 13 by a straight advancement component produced by the rotational movement, so that the movable plug 3 can be inserted into the power source side terminal 13 by weak operational force. That is, the movable plug 3 is always applied with sliding movement resistance from the load side terminal 12 at an insertion stroke in inserting the movable plug 3 into the load side terminal 12. In inserting the movable plug 3 into the power source side terminal 13, the movable plug 3 is applied with sliding movement resistance from the power source side terminal 13 in addition to the sliding movement resistance from the load side terminal. Therefore, large insertion force is needed, however, in inserting the movable plug 3 into the power source side terminal 13, the movable plug 3 is rotated, the movable plug 3 is inserted thereinto by converting the rotational force into the insertion force, so that the movable plug 3 can be inserted by weak operational force.

The movable plug 3 is provided with the operating lever 40 having the projections 42, and the conductive portion 41 is rotatably supported by the operating lever 40. Therefore, even when the operating lever 40 of the movable plug 3 is rotated, the conductive portion 41 is not rotated but is inserted into the power source side terminal 13 only by straight movement and is moved at inside of the load side terminal 12. Therefore, there is not sliding movement between the conductive portion 41 and the power source side terminal 13 and the load side terminal 12 produced by rotational operation and wear or the like is reduced. Further, since there is not rotational sliding movement, rotational operating force of the movable plug 3 is restrained to be low.

The guide groove 10 is provided with the projection pickup portion 10*a* having a large width on the insertion port side at which the projection 42 is firstly inserted thereinto, the width being gradually narrowed toward the insertion depth. Therefore, in inserting the movable plug 3 into the apparatus main body 2, a rotational position permitting insertion of the movable plug 3 is widened, so that operation of inserting the movable plug 3 is facilitated.

The apparatus main body 2 is provided with the sacrifice electrode portion 14 electrically connected to the power source side terminal 13. The load side terminal 12, the sacrifice electrode portion 14 and the power source side terminal 13 are arranged to shift in the direction of moving the movable plug 3 such that the movable plug 3 is brought into contact with the load side terminal 12, the sacrifice electrode portion 14 and the power source side terminal 13 in this order in the procedure of moving the conductive portion 41 of the movable plug 3 from the circuit opened position to the circuit closed position. Therefore, when the movable plug 3 is moved from the circuit opened position to the circuit closed position, the conductive portion 41 of the movable plug 3 is brought into contact with the sacrifice electrode portion 14 prior to the power source side terminal 13, and when the conductive portion 41 of the movable plug 3 is brought into contact with the sacrifice electrode portion 14, current flows from the power source side 34 to the load side 27 via the sacrifice electrode portion 14 to thereby conduct electricity to the load portion 27 and thereafter, the conductive portion 41 of the movable plug 3 is brought into contact with the power source side terminal 13, so that arc discharge is not generated between the conductive portion 41 of the movable plug 3 and the power source side terminal 13. Further, parts of the apparatus are constituted only by the load side terminal 12, the ground side terminal 11 and the movable plug 3 electrically connected to these as well as the sacrifice electrode portion 14. Therefore, terminals can be prevented from being melted by arc discharge by the apparatus which is small-sized and inexpensive.

Although the guide grooves 10 are provided at the apparatus main body 2 and the projections 42 are provided at the movable plug 3, even when the projections 42 are provided at the apparatus main body 2 and the guide grooves 10 are provided at the movable plug 3, respectively, contrary thereto, similar operation and effect are achieved.

Although according to the second embodiment, at the circuit opened position, the conductive portion 41 of the movable plug 3 is brought into contact with the load side terminal 12 arranged at the position proximate to the plug insertion port 9, the conductive portion 41 may be provided such that the movable plug 3 is not brought into contact with even the load side terminal 12. In this case, it is necessary to separately provide a measure against discharge from the load portion 27 in a circuit breaking state. Although according to the second embodiment, there is provided the sacrifice electrode portion 14 electrically connected to the power source side terminal 13, the sacrifice terminal 14 may not be provided. When the sacrifice electrode portion 14 is not provided, there may be provided an arrangement in which the power source side terminal 13 is provided at a position proximate to the plug insertion port 9 of the apparatus main body 2, the load side terminal 12 is provided at a position remote therefrom. In inserting the conductive portion 41 of the movable plug 3, the conductive portion 41 is firstly brought into contact with the power source side terminal 13 and successively brought into contact with the load side terminal 12 to thereby reverse the order.

As described above, according to the circuit breaking apparatus 1, when the movable plug 3 is moved from the circuit opened position to the circuit closed position, the ground side terminal 11 is moved to the separated position in cooperation with movement of the movable plug 3 to thereby electrically break the ground side terminal 11 and the load side terminal 12 and when the movable plug 3 is moved from the circuit closed position to the circuit opened position, the ground side terminal is moved to the contact position in cooperation with movement of the movable plug 3 to thereby electrically connect the ground side terminal 11 and the load side terminal 12. Therefore, when the circuit breaking apparatus 1 is brought into the circuit broken state from the circuit conducted state, charge current charged to a capacitor or the like of the load portion 27 is discharged. Further, it is not necessary for an operator to separately carry out operation for discharging the load portion.

According to the second embodiment, the ground side terminal 11 is provided with the pair of contact portion holders 17 arranged on the left and the right sides with the insertion center axis (movement center axis) of the movable plug 3 as a boundary and the pair of contact portions 18 supported by the respective contact portion holders 17. At the contact positions, the pair of contact portion holders 17 are arranged on a movement locus of the movable plug 3. At the separated position, the contact portion holders 17 are arranged at a position at which the pair of contact portion holders 17 are moved in directions separating from each other by press force of the movable plug 3 to thereby slidingly move the conductive portion 41 of the movable plug 3. Therefore, when the movable plug 3 is inserted between the pair of contact portion holders 17, the pair of contact portion holders 17 press the movable plug 3 to position on the proper movement center axis (center axis C of the apparatus main body 2), so that the movable plug 3 is centered to move on the center axis C of the apparatus main body 2, operation of inserting the movable plug 3 is carried out smoothly, and stable contact of the movable plug 3 with the load side terminal 12 and the power source side terminal 13 is ensured. In inserting the movable plug 3, the pair of contact portion holders 17 slidingly move the conductive portion 41 of the movable plug 3 and therefore, there is achieved a cleaning effect for removing stain, adhered matter or the like of the conductive portion 41.

According to the second embodiment, the apparatus main body 2 is provided with the sacrifice electrode portion 14 electrically connected to the power source side terminal 13. The load side terminal 12, the sacrifice electrode portion 14 and the power source side terminal 13 are arranged to shift in the direction of moving the movable plug 3 such that the conductive portion 41 of the movable plug 3 is brought into contact with the load side terminal 12, the sacrifice electrode portion 14 and the power source side terminal 13 in this order in the procedure of moving the conductive portion 41 of the movable plug 3 from the circuit opened position to the circuit closed position. Therefore, when the movable plug is moved from the circuit opened position to the circuit closed position, the conductive portion 41 of the movable plug 3 is brought into contact with the sacrifice electrode portion 14 prior to the power source side terminal 13. When the conductive portion 41 of the movable plug 3 is brought into contact with the sacrifice electrode portion 14, current flows from the power source portion 34 to the load portion 27 via the sacrifice electrode portion 14 to thereby conduct electricity to the load portion 27 and thereafter, the conductive portion 41 of the movable plug 3 is brought into contact with the power source side terminal 13, so that arc discharge is not generated between the conductive portion 41 of the movable plug 3 and the power source side terminal 13, further, parts of the apparatus are constituted only by the power source side terminal 13, the load side terminal 12, the ground side terminal 11 and the movable plug for electrically connecting these as well as the sacrifice electrode portion 14. Therefore, melting of terminals by arc discharge can be prevented by the apparatus which is small-sized and inexpensive.

According to the second embodiment, the urging member is constituted by springs (ground springs 19), so that the urging member can be constituted simply and easily. The urging member may be constituted by members other than the springs so far as the contact portions 18 can be urged to the contact position side.

According to the second embodiment, although the movable plug 3 is moved between the circuit closed position and the circuit opened position by inserting and extracting the movable plug 3 into and from the apparatus main body 2, there may be constructed a constitution in which by operating a movable plug previously contained movably at inside of the apparatus main body 2 by an operating lever operable from outside of the apparatus main body, the movable plug is moved between the circuit closed position and the circuit opened position. Further, according to the second embodiment, although the movable plug 3 is provided linearly movably, the movable plug 3 may be moved rotationally and the invention is applicable regardless of a movement locus of the movable plug 3.

As described above, according to the circuit breaking apparatus 1, the apparatus main body 2 is provided with the sacrifice electrode portion 14 electrically connected to the power source side terminal 13. The load side terminal 12, the sacrifice electrode portion 14 and the power source side terminal 13 are arranged to shift in the direction of moving the movable plug 3 such that the conductive portion 41 of the movable plug 3 is brought into contact with the load side terminal 12, the sacrifice electrode portion 14 and the power source side terminal 13 in this order in the procedure of moving the conductive portion 41 of the movable plug 3 from the circuit opened position to the circuit closed position. Therefore, when the movable plug 3 is moved from the circuit opened position to the circuit closed position, the conductive portion 41 of the movable plug 3 is brought into contact with the sacrifice electrode portion 14 prior to the power source side terminal 13, and when the conductive portion 41 of the movable plug 3 is brought into contact with the sacrifice electrode portion 14, current flows from the power source portion 34 to the load portion 27 via the sacrifice electric pole to thereby conduct electricity to the load portion 27 and thereafter, the conductive portion 41 of the movable plug 3 is brought into contact with the power source side terminal 13. Therefore, arc discharge is not generated between the conductive portion 41 of the movable plug 3 and the power source side terminal 13. Parts of the apparatus are constituted only by the power source side terminal 13, the load side terminal 12, the ground side terminal 11 and the movable plug 3 for electrically connecting these as well as the sacrifice electrode portion 14. Therefore, melting of terminals by arc discharge can be prevented by the apparatus which is small-sized and inexpensive.

When the movable plug 3 is moved from the circuit opened position to the circuit closed position, or from the circuit closed position to the circuit opened position, the conductive portion 41 of the movable plug 3 is brought into contact with the sacrifice electrode portion 14 or separated from the sacrifice electrode portion 14, at this occasion, as described above, there is a possibility of generating arc discharge. If a metal melted by heat of the arc discharge is scattered to the load side terminal 12 or the power source side terminal 13, since the resin caps 23 and 30 are provided to the sides of the sacrifice electrode portion 14 of the load side terminal 12 and the power source side terminal 13 to thereby ensure spatial distances and creepage distances between the load side terminal 12 and the power source side terminal 13 and the sacrifice electrode portion 14, leakage current or the like produced by arc discharge of the sacrifice electrode portion 14 can be prevented from being generated. Further, by providing the rein caps 23 and 30 at the load side terminal 12 and the power source side terminal 13 on the sides of the sacrifice electrode portion 14, layout can be carried out to minimum distances while ensuring predetermined spatial distances and creepage distances between the sacrifice electrode portion 14 and the load side terminal 12 and between the sacrifice electrode portion 14 and the power source side terminal 13, so that the apparatus can be made compact in this respect.

According to the second embodiment, the load side terminal 12 and the power source side terminal 13 are provided with a shape of a cylinder ring with regard to the cylinder ring portions 21 and 28 and the multiple contact spring members 22 and 29 arranged at inner peripheral faces thereof. The respective multiple point contact spring members 22 and 29 are respectively fixed to the cylinder ring portions 21 and 28 by the resin caps 23 and 30. Therefore, the resin caps 23 and 30 are provided with a function of holding the multiple contact spring members 22 and 29, it is not necessary to separately provide members for fixing the multiple point contact spring members 23 and 30, so that a number of parts is reduced.

Third Embodiment

Figure 20:
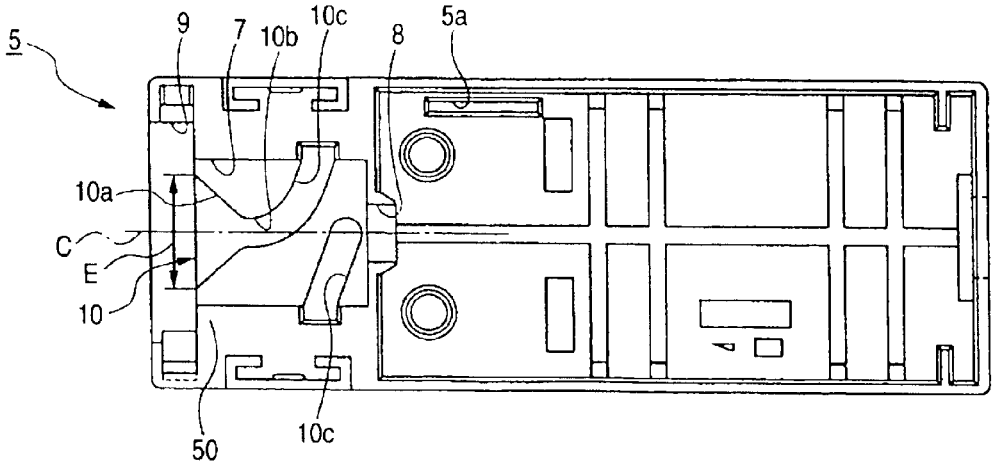
FIG. 20 shows a third embodiment of the invention and is an inner face view of a cover.
Figure 21:
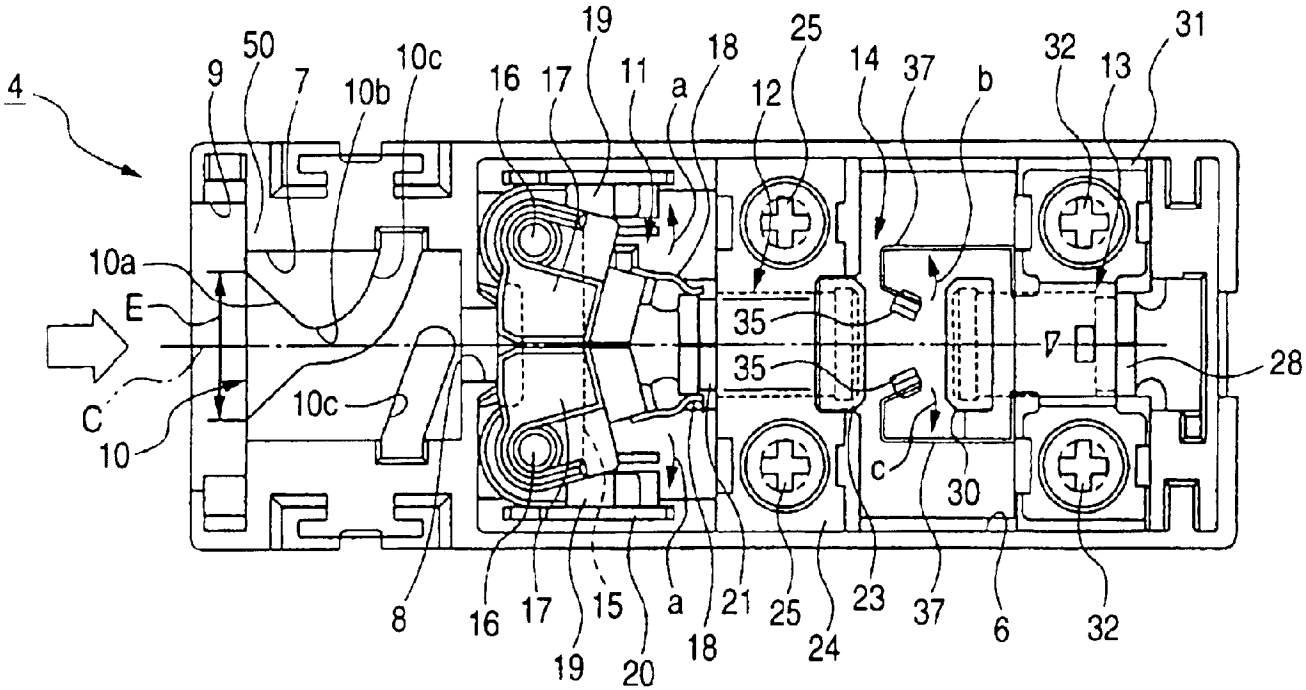
FIG. 21 shows the third embodiment of the invention and is an inner face view of a base member fixed with respective terminals and electric pole parts.
Figure 22:
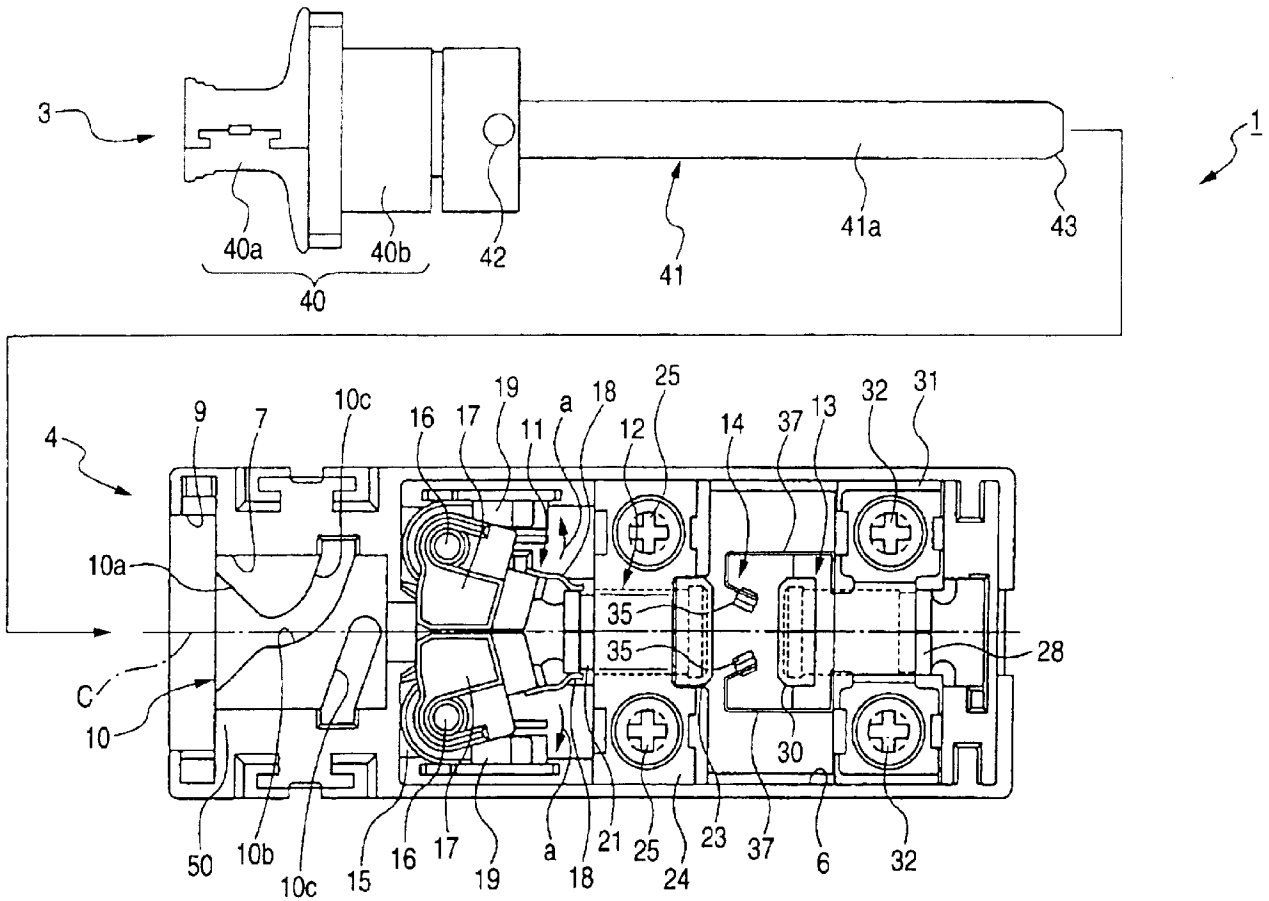
FIG. 22 shows the third embodiment of the invention and is an inner face view of the base member showing a state in which a movable plug is disposed at a circuit opened position.
Figures 23A, 23B:
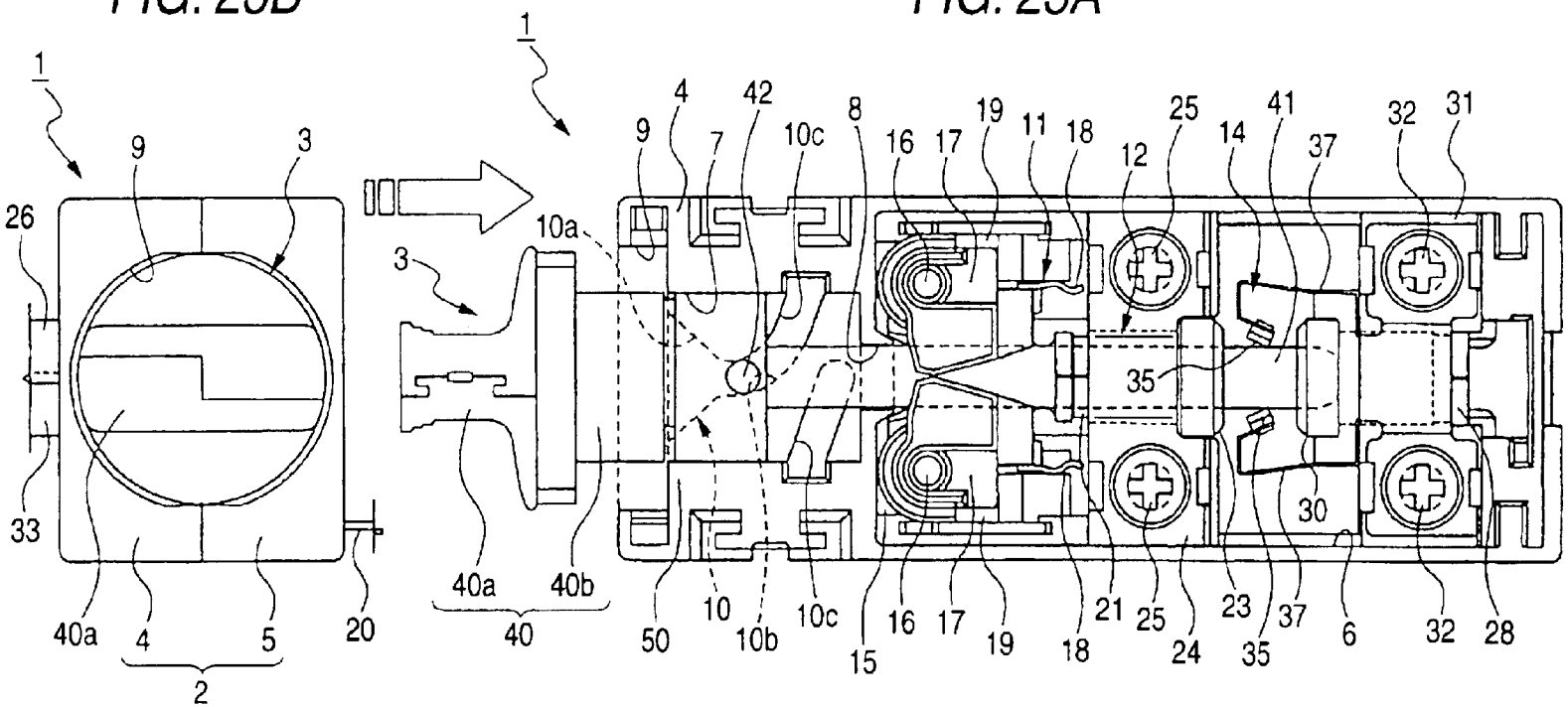
Figure 24A:
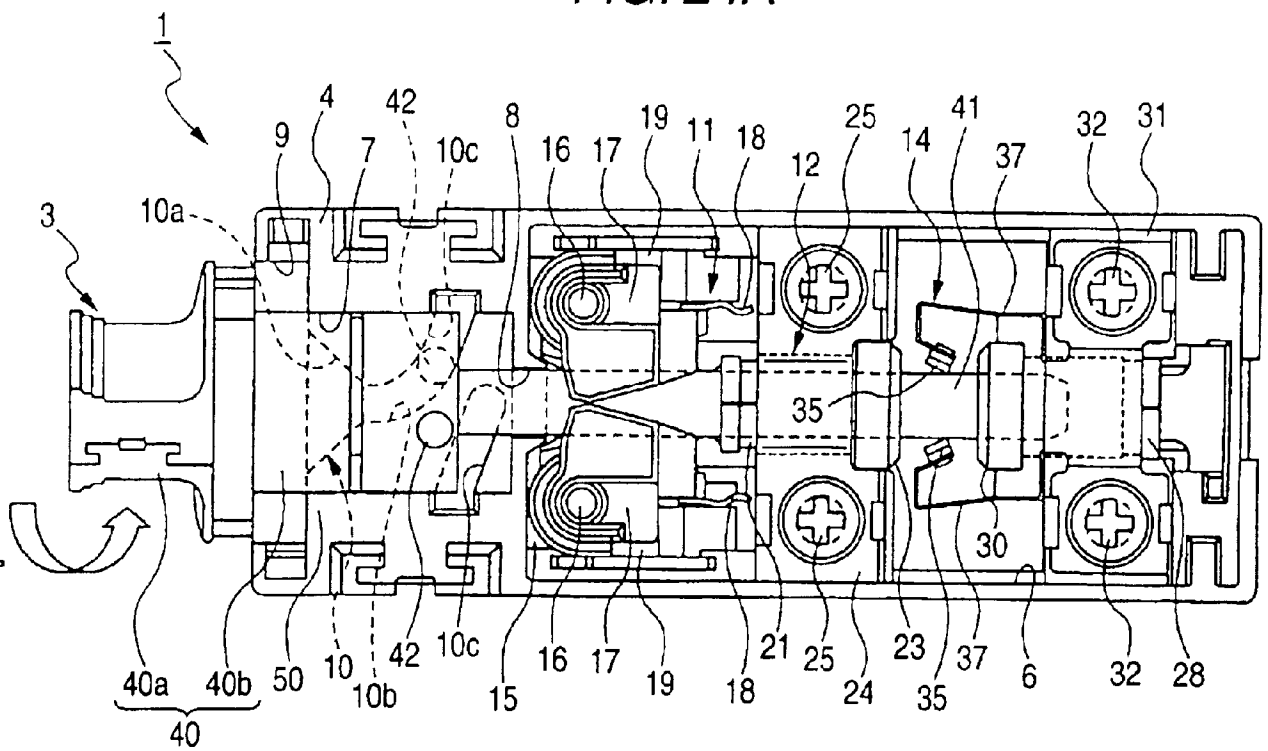
Figure 24B:
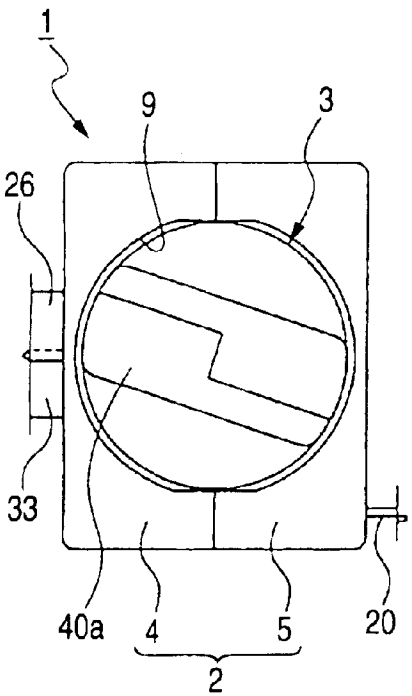
Figure 25:
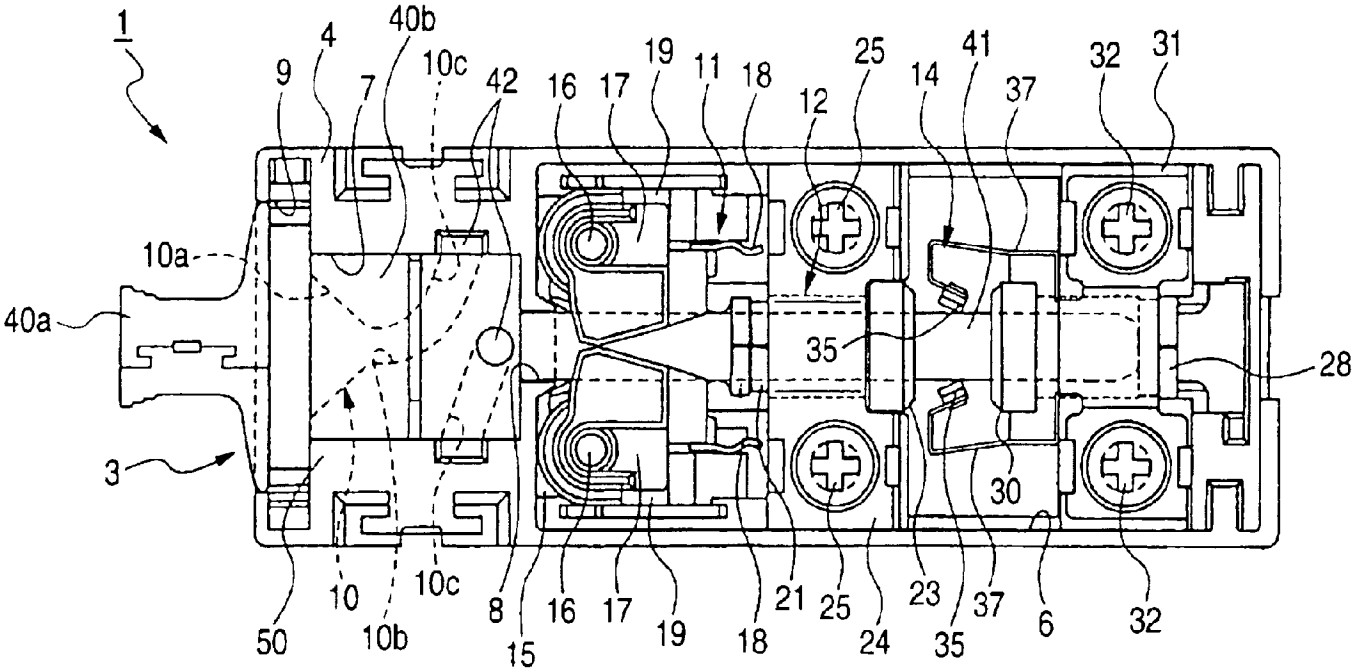
FIG. 25 shows the third embodiment of the invention and is an inner face view showing a state in which a projection of the movable plug is inserted into a deepest position of the guide portion for rotation of the guide groove.
Figure 26:
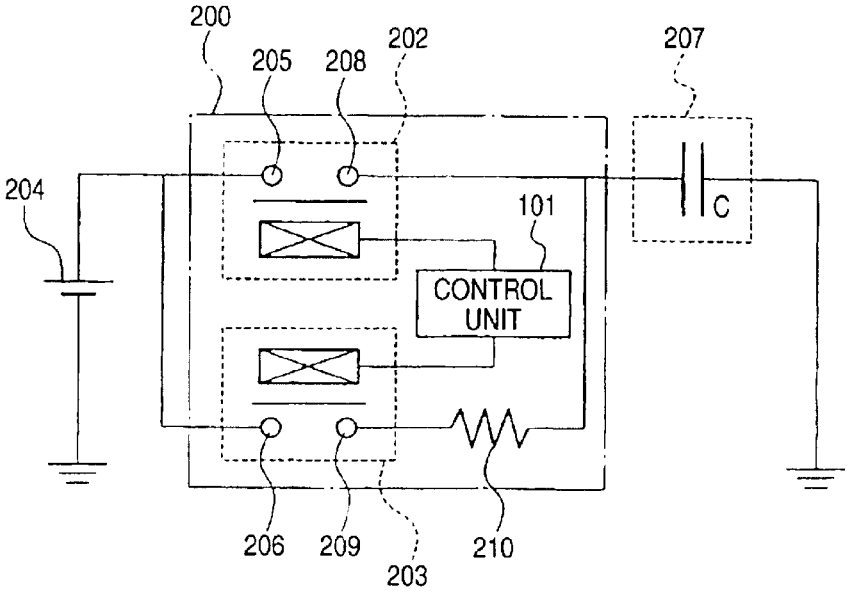
FIG. 26 is a circuit diagram of a circuit breaking apparatus according to a related example.
Figure 27:
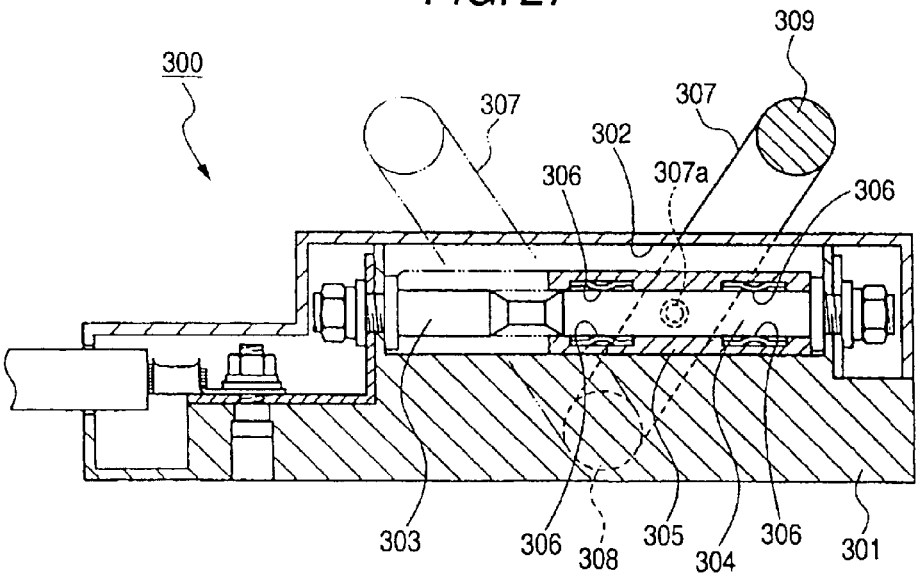
FIG. 27 is a sectional view of a circuit breaking apparatus of another related example.
Figure 28:
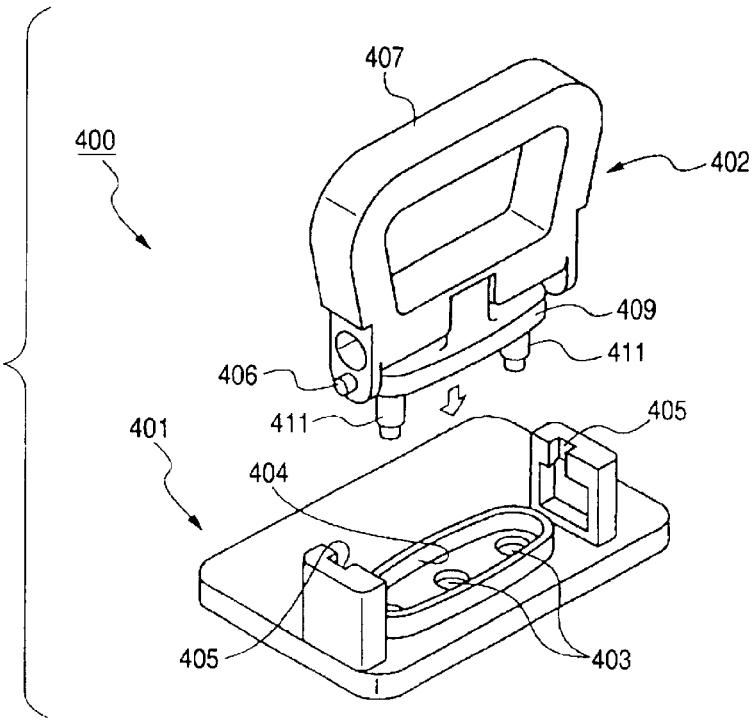
FIG. 28 is a perspective view of a circuit breaking apparatus according to another related example.
Figure 29:
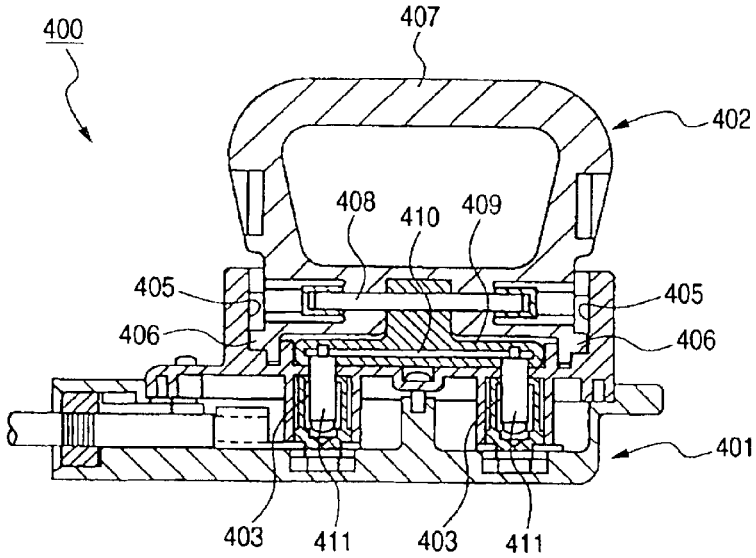
FIG. 29 is a sectional view of the circuit breaking apparatus according to the related example of FIG. 28.

FIGS. 20 through 25 show a third embodiment of the present invention. FIG. 20 is an inner face view of a cover 5. FIG. 21 is an inner face view of a base member 4 to which respective terminals and electric pole parts are fixed. FIG. 22 is an inner face view of the base member showing a state in which the movable plug is disposed at a circuit opened position. FIG. 23A is an inner face view of the base member showing a state in which a projection of the movable plug advances into a rotation introducing guide portion of a guide groove. FIG. 23B is a side view of the circuit breaking apparatus in such a state. FIG. 24A is an inner face view of the base member showing a state in which the projection of the movable plug advances into a guide portion for rotation of the guide groove. FIG. 24B is a side view of the circuit breaking apparatus in such a state. FIG. 25 is an inner face view of the base member showing a state in which the projection of the movable plug is inserted up to a deepest position of the guide portion for rotation.

As shown in FIG. 20 through FIG. 25, what differs by comparing the circuit breaking apparatus 1B according to the third embodiment and the circuit breaking apparatus 1 according to the second embodiment, is only the constitution of the guide grooves 10.

The plug insertion port 9 has a diameter slightly larger than a maximum diameter portion of an operating lever 40 made of synthetic resin, mentioned below. The plug inserting chamber 7 is formed by a diameter slightly larger than a circuit cylinder supporting portion 40*b* of the movable plug 3. Two guide grooves 10 for guiding the movable plug 3 at positions opposed to each other by 180 degrees are provided at an inner peripheral face of the plug inserting chamber 7. Each of the respective guide grooves 10 at the two locations, is constituted by: a projection pickup portion 10*a* having a width several times as large as that of a projection 42 of the movable plug 3 at an opening position of the plug insertion port 9, the width being gradually narrowed from the plug insertion port 9 toward a depth side; a rotation introducing guide portion 10*b* having a large radius of curvature communicated to a deepest portion of the projection pickup portion 10*a*, having a constant width to a degree slightly larger than the width of the projection 42 of the movable plug 3 and directed in a skewed depth direction relative to a direction orthogonal to a direction of the center axis C of the apparatus main body 2 (direction of inserting the movable plug 3); and a guide portion 10*c* for rotation communicated to a deepest portion of the rotation introducing guide portion 10*b*, having a constant width slightly larger than the width of the projection 42 of the movable plug 3 and extended to the depth side in a direction skewed to a direction orthogonal to the direction of the center axis C of the apparatus main body 2 (direction of inserting the movable plug 3).

When the conductive portion 41 of the movable plug 3 is inserted up to a position of being brought into contact with the pair of electric pole pieces 35, 35 of the sacrifice terminal 14, the projections 42 reach the deepest positions of the projection pickup portions 10*a* by being guided by the projection pickup portions 10*a* of the guide grooves 10, thereby, the operating lever 40 is disposed at a regular rotational position.

When the conductive portion 41 of the movable plug 3 passes through the position of being brought into contact with the pair of electric pole piece portions 35, 35 of the sacrifice terminal 14, as shown by FIG. 23A, the projections 42 of the movable plug 3 enter the rotation introducing guide portions 10*b* of the guide grooves 10, and the projections 42 are moved along the rotation introducing guide portions 10*b* which are curved significantly, so that the operator is urged to carry out rotational operation.

By the urged rotation, the operation of inserting the movable plug 3 is naturally added with the rotational operation. When the projections 42 of the movable plug 3 reach the deepest portions of the rotation introducing guide portions 10*b* by the rotational operation, the operation operating lever 40 is rotated by 90 degrees or less in the clockwise direction by continuity of the above-described rotational operation. Then, as shown by FIG. 24A, the projection portions 42 are moved to the depth sides of the guide portion 10*c* for rotation along the guide portions 10*c* for rotation and by the rotational movement, and then the conductive portion 41 of the movable plug 3 is made to advance to the depth side by an amount of a stroke in the direction of the center axis C of the guide portions 10*c* for rotation. By the stroke, the conductive portion 41 is inserted into the cylinder ring portion 28 of the power source side terminal 13 and the side face 41*a* in the circumferential shape of the conductive portion 41 is brought into contact with the multiple point contact spring member 29 in the ring-like shape at inside of the cylinder ring portion 28 in a state of being exerted with elastic force. At this occasion, although the load side terminal 12 and the power source side terminal 13 are connected to each other via the conductive portion 41, current has already been supplied to a capacitor or the like of the load portion 27 via the sacrifice electrode portion 14. Therefore, arc discharge is not generated. As shown by FIG. 25, a position at which the projections 42 of the movable plug 3 is disposed at the deepest portions of the guide portions 10*c* for rotation of the guide groove 10, is the circuit closed position of the movable plug 3, thereby, operation of inserting the movable plug 3 is finished.

Other constitution is similar to that of the second embodiment. Therefore, the same notations are attached thereto in the drawing and an explanation thereof will be omitted.

As described above, according to the circuit breaking apparatus 1B, the operator operates the movable plug 3 per se, and the movable plug 3 is inserted into and drawn from the apparatus main body 2, thereby, the interval between the load side terminal 12 and the power source side terminal 13 can be conducted and broken. Therefore, it is unnecessary to separately provide an operating lever member as in the related example and the circuit breaking apparatus 1B can be made compact.

When the movable plug 3 is inserted into the apparatus main body 2, the projections 42 are moved along the guide grooves 10 by the insertion force, and the movable plug 3 is inserted into the apparatus main body 2 and brought into contact with the load side terminal 12 arranged on the side of the insertion port. When the movable plug 3 is further inserted from this state, the projections 42 reach the rotation introducing guide portions 10*b* of the guide grooves 10, the rotational operation is urged without bump feeling since the radius of curvature of the rotation introducing guide portion 10*b* is large. When the movable plug 3 is operated to rotate by the urged rotation, by moving the projections 42 in the guide portions 10*c* for rotation, the movable plug 3 is inserted while being rotated, and by the insertion stroke (component of the guide portion 10*c* for rotation in the inserting direction), the conductive portion 41 is brought into contact with the power source side terminal 13 arranged at the deepest portion of the insertion port. Therefore, the reduction in the operational force of the movable plug 3 can be achieved, further, the incomplete fitted state produced by incomplete insertion of the movable plug 3 can be prevented from being brought about.

A detailed description will be given here of reason of capable of inserting the movable plug 3 by weak insertion force. When the movable plug 3 is inserted into the load side terminal 12 and during the insertion stroke, the movable plug 3 is always applied with sliding movement resistance from the load side terminal 12. When the movable plug 3 is inserted into the power source side terminal 13, the movable plug 3 is applied with sliding movement resistance from the power source side terminal 13 in addition to the sliding movement resistance from the load side terminal 12. Therefore, large insertion force is needed, however, in inserting into the power source side terminal 13, since the movable plug 3 is rotated and is inserted thereinto by converting the rotational force into the insertion force, the movable plug 3 can be inserted by weak operational force. Particularly, according to the third embodiment, the operation is effective since the movable plug 3 is also applied with sliding movement resistance from the ground side terminal 11.

The load side terminal 12 and the power source side terminal 13 are respectively provided with the shape of the cylinder ring. The conductive portion 41 of the movable plug 3 is provided with the shape of the circular cylinder rod inserted into the shape of the circular ring. By inserting the conductive portion 41 of the movable plug 3 into the load side terminal 12 and the power source side terminal 13, the load side terminal 12 and the power source side terminal 13 are electrically connected. Therefore, the conductive portion 41 of the movable plug 3 and the load side terminal 12 and the power source side terminal 13 are brought into contact with each other over entire faces thereof in the circumferential shape, so that a stable contact state is achieved.

The movable plug 3 is provided with the operating lever 40 provided with the projections 42. The conductive portion 41 is rotatably supported by the operating lever 40. Therefore, even when the operating lever 40 of the movable plug 3 is rotated, the conductive portion 41 is not rotated but is inserted into the power source side terminal 13 only by straight advancement movement and is moved at inside of the load side terminal 12. Therefore, there is not sliding movement between the conductive portion 41 and the power source side terminal 13 and the load side terminal 12 by the rotational operation and wear or the like is reduced. Since there is not rotational sliding movement, the rotational operation force of the movable plug 3 can be restrained to be low.

The guide groove 10 is provided with the projection pickup portion 10*a* having the large width on the side of the insertion port to which the projection 42 is firstly inserted, the width being gradually narrowed toward the insertion depth and therefore. In inserting the movable plug 3 into the apparatus main body 2, the rotational position of permitting to insert the movable plug 3 is widened. Therefore, operation of inserting the movable plug 3 is facilitated.

The apparatus main body 2 is provided with the sacrifice electrode portion 14 electrically connected to the power source side terminal 13, the load side terminal 12, the sacrifice electrode portion 14 and the power source side terminal 13 are arranged to shift in the direction of moving the movable plug 3 such that the conductive portion 41 of the movable plug 3 is brought into contact with the load side terminal 12, the sacrifice electrode portion 14 and the power source side terminal 13 in this order in the procedure of moving the conductive portion 41 from the circuit opened position to the circuit closed position. Therefore, when the movable plug 3 is moved from the circuit opened portion to the circuit closed position, the conductive portion of the movable plug 3 is brought into contact with the sacrifice electrode portion 14 prior to the power source side terminal 13, and when the conductive portion 41 of the movable plug 3 is brought into contact with the sacrifice electrode portion 14, current flows from the power source portion 34 to the load portion 27 via the sacrifice electrode portion 14. After electricity is conducted to the load portion 27, the conductive portion 41 of the movable plug 3 is brought into contact with the power source side terminal 13. Therefore, arc discharge is not generated between the conductive portion 41 of the movable plug 3 and the power source side terminal 13. Parts of the apparatus are constituted only by the power source side terminal 13, the load side terminal 12, the ground side terminal 11 and the movable plug 3 for electrically connecting these as well as the sacrifice electrode portion 14. Therefore, melting of terminals by arc discharge can be prevented by the apparatus which is small-sized and inexpensive.

Although the rotation introducing guide portion 10*b* of the guide groove 10 is provided in the curved shape having the large radius of curvature directed in the skewed depth direction relative to the direction orthogonal to the direction of the center axis C in the apparatus main body 2 (direction in inserting the movable plug 3), similar operation and effect are achieved even when the guide portion 10*b* is provided in a linear shape having large taper angle relative to the direction orthogonal to the direction of the center axis C of the apparatus main body 2 (direction of inserting the movable plug 3). Further, although the apparatus main body 2 is provided with the guide grooves 10 and the movable plug 3 is provided with the projections 42, even when the apparatus main body 2 is provided with the projections 42 and the movable plug 3 is provided with the guide grooves 10, respectively, contrary thereto, similar operation and effect are achieved.

Although according to the third embodiment, the conductive portion 41 of the movable plug 3 is brought into contact with the load side terminal 12 arranged at a position proximate to the plug insertion port 9 at the circuit opened position, the conductive portion 41 may be provided such that the conductive portion 41 is not brought into contact also with the load side terminal 12. In this case, it is necessary to separately provide a measure against discharge from the load portion 27 in the circuit broken state. Further, although according to the third embodiment, there is provided the sacrifice electrode portion 14 electrically connected to the power source side terminal 13, the sacrifice terminal 14 may not be provided. In this case, there may be constructed a constitution in which the power source side terminal 13 is provided at a position proximate to the plug insertion port 9 of the apparatus main body 2, and the load side terminal 12 is provided at a position remote therefrom.

In inserting the conductive portion 41 of the movable plug 3, the conductive portion 41 is firstly brought into contact with the power source terminal 13 and successively brought into contact with the load side terminal 12 to thereby arrange the load side terminal 12 and the power source side terminal 13 in a reversed order.

As has been explained above, according to the invention, there can be provided the circuit breaking apparatus which is small-sized, inexpensive and capable of preventing terminals from being melted by arc discharge without using two relay switches and a control circuit thereof as in the conventional example.

According to the invention, when the conductive portion of the movable plug is brought into contact with the sacrifice electric pole with the resistor, the power source portion is connected to the load portion via the resistor. Therefore, only small current is made to flow therebetween, abruptly increased current does not flow between the conductive portion and the sacrifice electrode with the resistor, successively. When the conductive portion of the movable plug is brought into contact with the through sacrifice electric pole, although the power source portion is connected to the load portion directly without interposing the resistor, since current to some degree flows by prior electricity conduction, abruptly increased current is not made to flow between the conductive portion and the through sacrifice electric pole. Therefore, not only arc discharge between the conductive portion of the movable plug and the sacrifice electric pole can be restrained to a minimum but also abruptly increased current does not flow in both of the sacrifice electric poles and durability of the sacrifice electric poles is promoted.

According to the invention, the sacrifice terminal may simply be connected electrically through to the power source side terminal, so that the constitution is simple.

According to the invention, there can be provided a stable contact state which is not influenced by the arc mark between the conductive portion of the movable plug and the power source side terminal.

According to the invention, the apparatus can be made compact and erroneous insertion of the movable plug can be prevented.

According to the invention, the contact portion of the movable plug and the first terminal and the second terminal are brought into contact with each other over entire faces thereof in the circumferential shapes and therefore, so that a stable contact state is achieved.

According to the invention, the movable plug can be inserted into the second terminal by weak operating force.

According to the invention, even when the operating lever of the movable plug is rotated, the conductive portion is not rotated but is inserted into the second terminal or the first terminal arranged at the insertion depth side only by straight movement thereof. Therefore, there is not sliding movement between the conductive portion and the second terminal and the first terminal by rotation, wear or the like is reduced. Further, since there is not rotational sliding movement, rotational operating force of the movable plug can be restrained to be low.

According to the invention, in inserting the movable plug into the apparatus main body, a rotational position permitting to insert the movable plug is widened and therefore, operation of inserting the movable plug is facilitated.

According to the invention, when the apparatus is brought into the circuit broken state from the circuit conducted state, charge current charged to a capacitor or the like of the load portion is discharged. It is not necessary for an operator to separately carry out operation for discharging the load portion.

According to the invention, the movable plug is centered to move on the movement center axis, operation of inserting the movable plug is smoothly carried out, further, stable contact thereof is ensured for the load side terminal and the power source side terminal. Further, in moving the movable plug, the pair of contact portion holders slidingly move the conductive portion of the movable plug. Therefore, the movable plug is centered to move on the predetermined movement axis and there is achieved a cleaning effect of removing stain, adhered matter or the like of the conductive portion.

According to the invention, melting of terminals by arc discharge can be prevented by the apparatus which is small-sized and inexpensive.

According to the invention, since the urging means is a spring and therefore, the urging member can be constituted simply and easily.

According to the invention, leakage current or the like by arc discharge of the sacrifice electric pole can be prevented from being caused. Further, by respectively providing the resin caps to the load side terminal and the power source side terminal on the sides of the sacrifice electric pole, layout can be carried out to minimum distances while ensuring predetermined spatial distances and creepage distances between the sacrifice electric pole and the load side terminal and between the sacrifice electric pole and the power source side terminal. Therefore, the apparatus can be made compact also in this respect.

According to the invention, the insulating cap is provided with a function of holding the multiple point contact spring member and it is not necessary to separately provide a member for fixing the multiple point contact spring member, so that a number of parts is reduced.

According to the invention, when the movable plug is inserted into the apparatus main body, the projection is moved along the guide groove by the insertion force and the movable plug is inserted into the apparatus main body and is brought into contact with the first terminal or the second terminal arranged on the side of the insertion port. When the movable plug is further inserted from the state, the projection reaches the rotation introducing guide portion of the guide groove, rotational operation is urged without bump feeling since the radius of curvature or the taper angle of the rotation introducing guide portion is large. When the movable plug is operated to rotate by the urged rotation, the projection is moved in the guide portion for rotation to thereby insert the movable plug while being rotated and by the insertion stroke, the conductive portion is brought into contact with the second terminal or the first terminal arranged at an insertion port depth portion. Therefore, the reduction in the operational force of the movable plug can be achieved, further, the incomplete fitted state by the incomplete insertion of the movable plug can firmly be prevented from being brought about.

What is claimed is:

1. A circuit breaking apparatus comprising:

an apparatus body;

a load side terminal connected to a load portion and provided in the apparatus body;

a power source side terminal connected to a power source portion and provided in the apparatus body;

a sacrifice electrode portion connected to the power source side terminal and provided in the apparatus body; and a movable plug including a conductive portion and movable with respect to the apparatus body between a circuit opened position in which the movable plug does not electrically connect the load side terminal to the power source side terminal and a circuit closed position in which the movable plug electrically connects the load side terminal to the power source side terminal, wherein the load side terminal, the power source side terminal and the sacrifice electrode portion are shifted in a direction of moving the movable plug such that when the movable plug is moved from the circuit opened position to the circuit closed position, the conductive portion is brought into contact with the load side terminal, the sacrifice electrode portion and the power source side terminal in order.

2. The circuit breaking apparatus according to claim 1, wherein the sacrifice electrode portion includes a first sacrifice electric pole electrically connected to the power source side terminal through a resistor, and a second sacrifice electric pole electrically directly connected to the power source side terminal, and when the movable plug is moved from the circuit opened position to the circuit closed position, the movable plug is firstly brought into contact with the first sacrifice electric pole and secondly brought into contact with the second sacrifice electric pole.

3. The circuit breaking apparatus according to claim 1, wherein the sacrifice electrode portion is electrically directly connected to the power source side terminal.

4. The circuit breaking apparatus according to claim 1, wherein a first face of the conductive portion firstly brought into contact with the sacrifice electrode portion and a second face of the conductive portion brought into contact with the power source side terminal, differ from each other.

5. The circuit breaking apparatus according to claim 4, wherein the conductive portion includes a side face which extends along the direction of moving the movable plug and corresponds to the first face and a tapered face on a front end thereof corresponding to the second face.

6. The circuit breaking apparatus according to claim 1, wherein the sacrifice electrode portion includes a sacrifice electric pole contactable with the conductive portion and an elastic arm portions connecting the sacrifice electric pole with the power source side terminal.

7. The circuit breaking apparatus according to claim 5, wherein the sacrifice electrode portion includes a sacrifice electric pole contactable with the conductive portion and an elastic arm portions connecting the sacrifice electric pole with the power source side terminal, and the sacrifice electric pole is elastically slidable on the side face of the conductive portion.

8. A circuit breaking apparatus comprising:

an apparatus body;

first and second terminals provided in the apparatus body, respectively;

a movable plug including a conductive portion and movable with respect to the apparatus body between a circuit opened position in which the movable plug does not electrically connect the first terminal to the second terminal and a circuit closed position in which the movable plug electrically connects the first terminal to the second terminal;

a guide groove provided at one of the apparatus body and the movable plug; and a projection insertable into the guide groove and provided at the other of the apparatus body and the movable plug, wherein the movable plug is inserted into the apparatus body only when the projection is inserted into the guide groove.

9. The circuit breaking apparatus according to claim 8, wherein the first and second terminals have a tubular cylindrical shape, and the conductive portion is a cylindrical rod insertable into the first and second terminals, respectively, so that the conductive portion is electrically connected with the first and second terminals.

10. The circuit breaking apparatus according to claim 9, wherein the guide groove has a rotation guide portion extending to a depth side in a direction skewed to a direction orthogonal to a direction of inserting the movable plug, and when the conductive portion is in contact with the first and second terminals, the projection is slid along the rotation guide portion.

11. The circuit breaking apparatus according to claim 10, wherein the movable plug includes an operation lever to which the projection or the guide grooves is provided and which rotatably supports the conductive portion.

12. The circuit breaking apparatus according to claim 8, wherein the guide groove includes a projection pickup portion having a large width on a side of an insertion port of the apparatus body firstly inserted with the projection and the width is gradually narrowed toward the insertion depth.

13. The circuit breaking apparatus according to claim 8, wherein the guide groove including:

a projection pickup portion including a first end portion having a width three to six times as large as a width of the projection on a side of an insertion port of the apparatus body, and a second end portion having a width slightly wider than the width of the projection, the width of the projection pickup portion being gradually narrowed from the first end portion toward the second end portion;

a straight advancement guide portion having a constant width slightly larger than the width of the projection and extending in an insertion direction of inserting the movable plug, one end thereof being communicated with the second end portion; and a rotation guide portion extending to a depth side in a direction skewed to a direction orthogonal to the insertion direction, and communicated with the other end of the straight advancement guide.

14. The circuit breaking apparatus according to claim 8, wherein the guide groove includes a rotation guide portion extending in a skewed depth direction relative to a direction orthogonal to a direction of inserting the movable plug, and a rotation introducing guide portion having a large radius of curvature in compared with that of the rotation guide portion, and when the movable plug is moved from the circuit opened position toward the circuit closed position, the projection is moved from a side of the rotation guide portion toward the rotation introducing guide portion.

15. The circuit breaking apparatus according to claim 14, wherein when the conductive portion is in contact with the first and second terminals, the projection is slid along the rotation guide portion.

16. The circuit breaking apparatus according to claim 8, wherein the guide groove includes a rotation guide portion extending in a skewed depth direction relative to a direction orthogonal to a direction of inserting the movable plug, and a rotation introducing guide portion having a large taper angle relative to the direction orthogonal to the direction of inserting the movable plug, and when the movable plug is moved from the circuit opened position toward the circuit closed position, the projection is moved from a side of the rotation guide portion toward the rotation introducing guide portion.

17. The circuit breaking apparatus according to claim 16, wherein when the conductive portion is in contact with the first and second terminals, the projection is slid along the rotation guide portion.

18. The circuit breaking apparatus according to claim 8, wherein the guide groove has a curved shape whose a radius of curvature varies.

19. A circuit breaking apparatus comprising:

an apparatus body;

a load side terminal connected to a load portion and provided in the apparatus body;

a ground side terminal which is connected to the ground, provided in the apparatus body, and movable between a contact position in which the ground side terminal is in contact with the load side terminal and a separated position in which the ground side terminal is separated from the load side terminal;

a power source side terminal connected to a power source portion and provided in the apparatus body;

a movable plug including a conductive portion and movable with respect to the apparatus body between a circuit opened position in which the conductive portion is not in contact with the power source side terminal and a circuit closed position in which the conductive portion is in contact with the load side terminal and the power source side terminal; and an urging member for urging the ground side terminal to the contact position, wherein the ground side terminal is in the contact position when the movable plug is in the circuit opened position, and wherein the ground side terminal is moved to the separated position against urge force of the urging member when the movable plug is moved from the circuit opened position to the circuit closed position.

20. The circuit breaking apparatus according to claim 19, wherein the ground side terminal includes a pair of contact portion holders opposed each other with respect to a movement center axis of the movable plug, in the contact position, the pair of contact portion holders are arranged on a movement locus of the movable plug, and in the separated position, the pair of contact portion holders are moved in directions separating from each other by a press force of the movable plug and arranged at a position for slidable contact with the conductive portion of the movable plug.

21. The circuit breaking apparatus according to claim 19, wherein the apparatus body is provided with a sacrifice electrode electrically connected to the power source side terminal, and when the movable plug is moved from the circuit opened position to the circuit closed position, the conductive portion is brought into contact with the load side terminal, the sacrifice electrode and the power source side terminal in order.

22. The circuit breaking apparatus according to claim 19, wherein the urging member is a spring.

23. A circuit breaking apparatus comprising:

an apparatus body;

a load side terminal connected to a load portion and provided in the apparatus body;

a power source side terminal connected to a power source portion and provided in the apparatus body;

a sacrifice electrode which is connected to the power source side terminal, provided in the apparatus body and interposed between the load side terminal and the power source side terminal;

a movable plug including a conductive portion and movable with respect to the apparatus body between a circuit opened position in which the movable plug does not electrically connect the load side terminal with the power source side terminal and a circuit closed position in which the movable plug electrically connects the load side terminal with the power source side terminal; and insulative caps provided at the load side terminal and the power source side terminal, respectively, wherein when the movable plug is moved from the circuit opened position to the circuit closed position, the conductive portion is brought into contact with the load side terminal, the sacrifice electrode and the power source side terminal in order.

24. The circuit breaking apparatus according to claim 23, wherein the insulative cap is provided at one end of the load side terminal facing the sacrifice electrode.

25. The circuit breaking apparatus according to claim 23, wherein the insulative cap is provided at one end of the power source side terminal facing the sacrifice electrode.

26. The circuit breaking apparatus according to claim 23, wherein each of the load side terminal and the power source side terminal includes a cylinder ring portion and a multiple point contact spring member arranged at an inner peripheral face of the cylinder ring portion, and the multiple point contact spring member is fixed to the cylinder ring portion by the insulative cap.

* * * * *